US012460890B2

(12) United States Patent
Underwood et al.

(10) Patent No.: US 12,460,890 B2
(45) Date of Patent: Nov. 4, 2025

(54) SIMULATED TRIGGER ASSEMBLIES

(71) Applicants: James Matthew Underwood, Kennesaw, GA (US); Larry Cullen Underwood, Canton, GA (US)

(72) Inventors: James Matthew Underwood, Kennesaw, GA (US); Larry Cullen Underwood, Canton, GA (US)

( * ) Notice: Subject to any disclaimer, the term of this patent is extended or adjusted under 35 U.S.C. 154(b) by 0 days.

(21) Appl. No.: 18/649,631

(22) Filed: Apr. 29, 2024

(65) Prior Publication Data

US 2024/0361096 A1 Oct. 31, 2024

Related U.S. Application Data

(60) Provisional application No. 63/462,750, filed on Apr. 28, 2023.

(51) Int. Cl.
*F41A 33/00* (2006.01)
*F41A 19/15* (2006.01)

(52) U.S. Cl.
CPC ..... *F41A 33/00* (2013.01); *F41A 19/15* (2013.01)

(58) Field of Classification Search
CPC ..... F41A 3/66; F41A 19/10; F41A 19/15; F41A 19/14; F41A 33/00; F41G 3/2655; F41G 3/26
USPC ..... 42/69.01
See application file for complete search history.

(56) References Cited

U.S. PATENT DOCUMENTS

| | | | | |
|---|---|---|---|---|
| 3,262,440 | A | 7/1966 | Kuhn | |
| 4,539,889 | A | 9/1985 | Glock | |
| 4,941,394 | A | 7/1990 | Zedrosser et al. | |
| 5,316,479 | A * | 5/1994 | Wong | F41A 33/00 600/587 |
| 5,913,261 | A | 6/1999 | Guhring et al. | |
| 6,298,594 | B1 | 10/2001 | Strayer | |
| 6,640,479 | B2 | 11/2003 | Gühring et al. | |
| 7,213,359 | B2 | 5/2007 | Beretta | |
| 7,997,260 | B2 | 8/2011 | Kaakkola et al. | |
| 8,646,201 | B2 | 2/2014 | Hughes et al. | |
| 9,052,149 | B2 | 6/2015 | Bender | |
| 9,207,027 | B1 | 12/2015 | Hannan et al. | |
| 9,599,422 | B2 | 3/2017 | Mundy | |
| 9,863,730 | B2 | 1/2018 | Elftmann | |
| 10,378,848 | B1 | 8/2019 | Galie et al. | |
| 10,557,684 | B2 * | 2/2020 | Hughes | F41A 3/66 |
| 10,670,360 | B2 | 6/2020 | Underwood et al. | |
| 10,690,430 | B2 | 6/2020 | Galie et al. | |
| 11,536,530 | B2 | 12/2022 | Underwood et al. | |
| 2005/0011098 | A1 | 1/2005 | Fagundes de Campos | |
| 2006/0207149 | A1 | 9/2006 | Lazor | |
| 2011/0167697 | A1 | 7/2011 | Geissele | |
| 2011/0185615 | A1 | 8/2011 | Gangl | |
| 2015/0020426 | A1 | 1/2015 | Neergaard | |

(Continued)

FOREIGN PATENT DOCUMENTS

CA 3218275 A1 * 5/2024 ..... F41A 33/00

*Primary Examiner* — John Cooper

(57) ABSTRACT

A simulated trigger assembly for a firearm includes at least one body with at least one recess, a magnet disposed within the at least one recess, an initial configuration, and a simulated fired configuration. In the initial configuration, the magnet is at least immediately adjacent to a moveable portion. In the simulated fired configuration, the moveable portion has moved to separate the moveable portion from the magnet.

20 Claims, 21 Drawing Sheets

(56) References Cited

U.S. PATENT DOCUMENTS

| | | | | |
|---|---|---|---|---|
| 2015/0226508 | A1* | 8/2015 | Hughes | F41A 19/69<br>434/21 |
| 2016/0054085 | A1 | 2/2016 | Miller, III | |
| 2016/0327357 | A1 | 11/2016 | Wheatley | |
| 2018/0087859 | A1 | 3/2018 | Underwood et al. | |
| 2020/0240733 | A1 | 7/2020 | Underwood et al. | |
| 2021/0262752 | A1 | 8/2021 | Seigler | |
| 2022/0178643 | A1* | 6/2022 | Hughes | F41A 33/02 |
| 2024/0157232 | A1* | 5/2024 | Eskilander | F41A 19/12 |

* cited by examiner

SIMULATED TRIGGER ASSEMBLIES

CROSS REFERENCE TO RELATED APPLICATION

This application is related to and claims priority benefit from U.S. Provisional Application No. 63/462,750 ("the '750 application"), filed on Apr. 28, 2023. The '750 application is hereby incorporated in its entirety by this reference.

FIELD OF THE INVENTION

The field of the invention relates to simulated trigger assemblies and training systems for firearms, particularly simulated trigger assemblies designed to be temporarily installed in existing various firearms for training purposes.

BACKGROUND

Many modern firearms and firearm accessories (including handguns, rifles, carbines, shotguns, etc.) are designed based on existing modular firearm systems. For example, many firearms and related accessories are designed for compatibility with the AR-15 variant (civilian) or M16/M4 (military) firearm platform (i.e., collectively AR-15 style firearms). Many of these products follow traditional designs based on industry standards and/or military specification (milspec). However, conventional systems for training based on inert or non-firing ammunition (i.e., dry fire) do not provide requisite firearm operation. Military, law enforcement, or other organizations may want to train firearm operators using dry-fire techniques as a supplement to live fire training, as part of a classroom portion of a training regimen, and/or for various other reasons.

To improve safety, training, and realism during dry fire scenarios while also reducing installation complexity, training costs, and noise, it may be desirable to design new simulated trigger assemblies that can be adapted for multiple firearm configurations.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to certain embodiments of the present invention, a simulated trigger assembly for a firearm comprises: at least one body comprising at least one recess; a magnet disposed within the at least one recess; an initial configuration; and a simulated fired configuration, wherein: in the initial configuration the magnet is at least immediately adjacent to a moveable portion; and in the simulated fired configuration the moveable portion has moved to separate the moveable portion from the magnet.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Although some of the illustrated embodiments shown in FIGS. 1-14 illustrate components of AR-15 style firearms, the features, concepts, and functions described herein are also applicable (with potential necessary alterations for particular applications) to AR-9, AR-10, handguns, rifles, carbines, pistols, shotguns, or any other type of firearm. Furthermore, the embodiments may be compatible with various calibers including rifle calibers such as, for example, 5.56×45 mm NATO, .223 Remington, 7.62×51 mm NATO, .308 Winchester, 7.62×39 mm, 5.45×39 mm; pistol calibers such as, for example, 9×19 mm, .45 ACP, .40 S&W, .380 ACP, 10 mm Auto, 5.7×28 mm; and shotgun calibers such as, for example, 12 gauge, 20 gauge, 28 gauge, .410 gauge, 10 gauge, 16 gauge.

Figure 1:
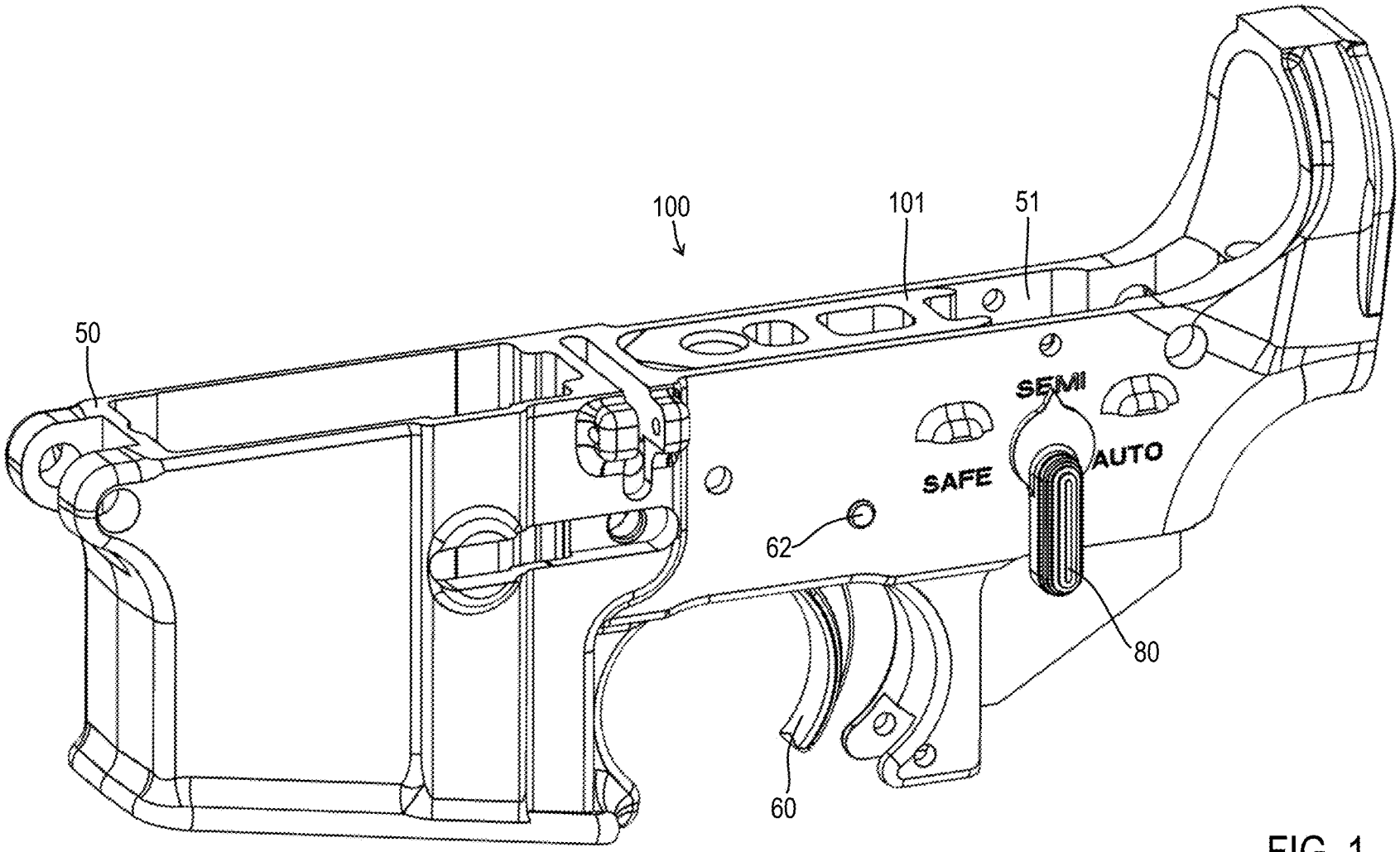
FIG. 1 is a front left perspective view of a simulated trigger assembly within a receiver according to certain embodiments of the present invention.
Figure 2:
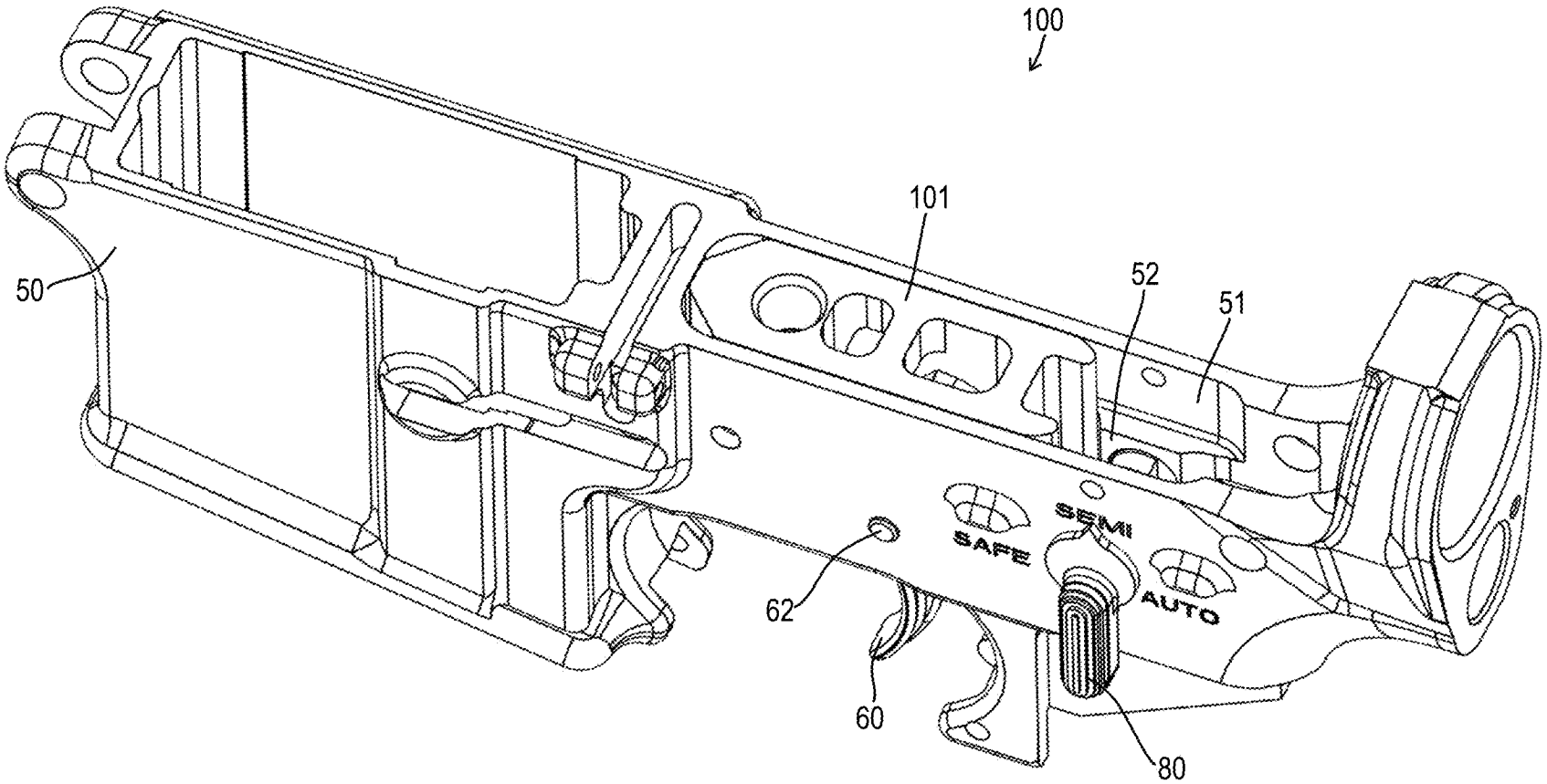
FIG. 2 is a top left perspective view of the simulated trigger assembly of FIG. 1.
Figure 3A:
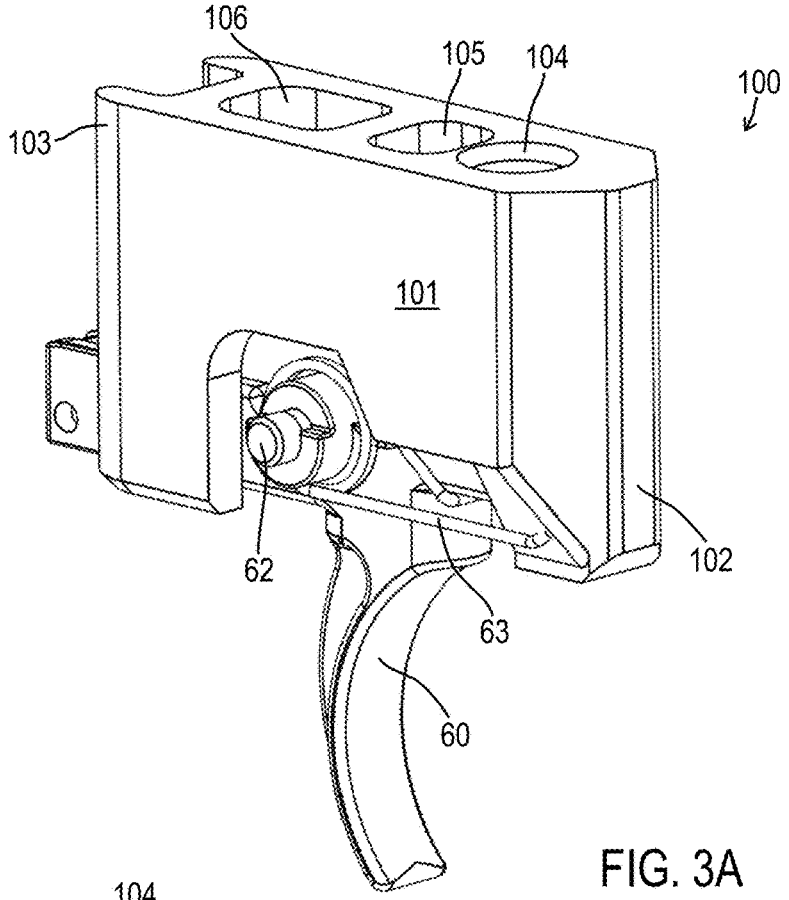
FIG. 3A is a front right perspective view of the simulated trigger assembly of FIG. 1.
Figure 3B:
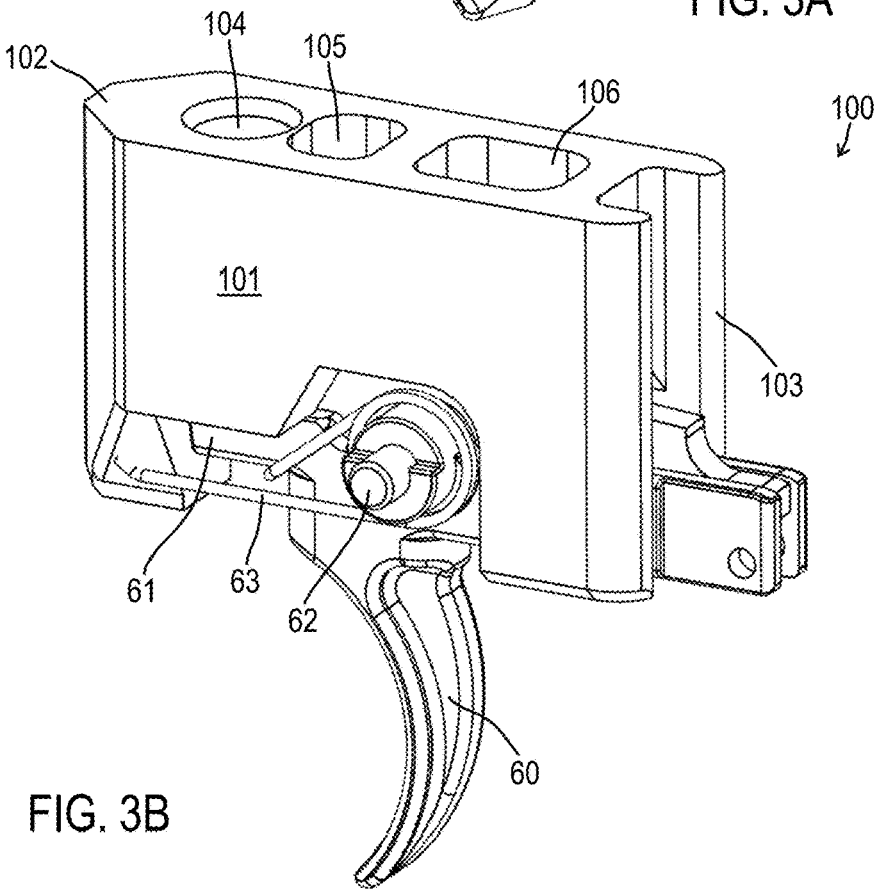
FIG. 3B is a rear left perspective view of the simulated trigger assembly of FIG. 1.
Figure 3C:
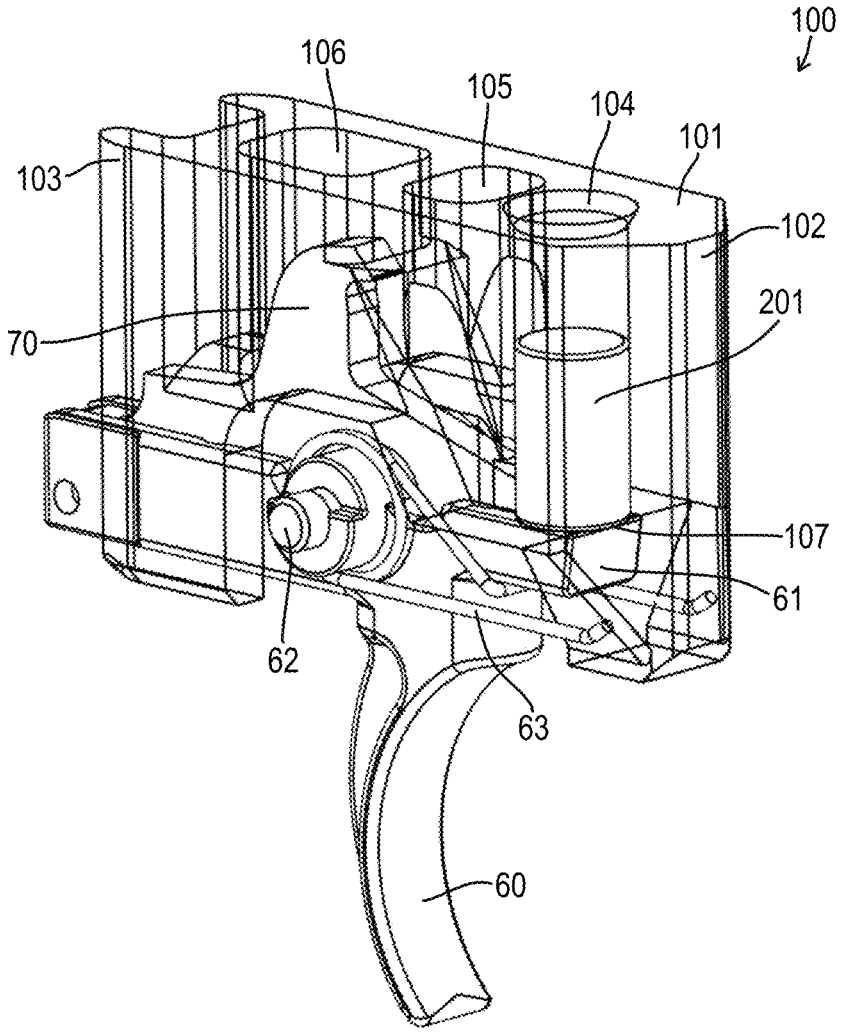
FIG. 3C is a front right perspective view of the simulated trigger assembly of FIG. 1.
Figure 4A:
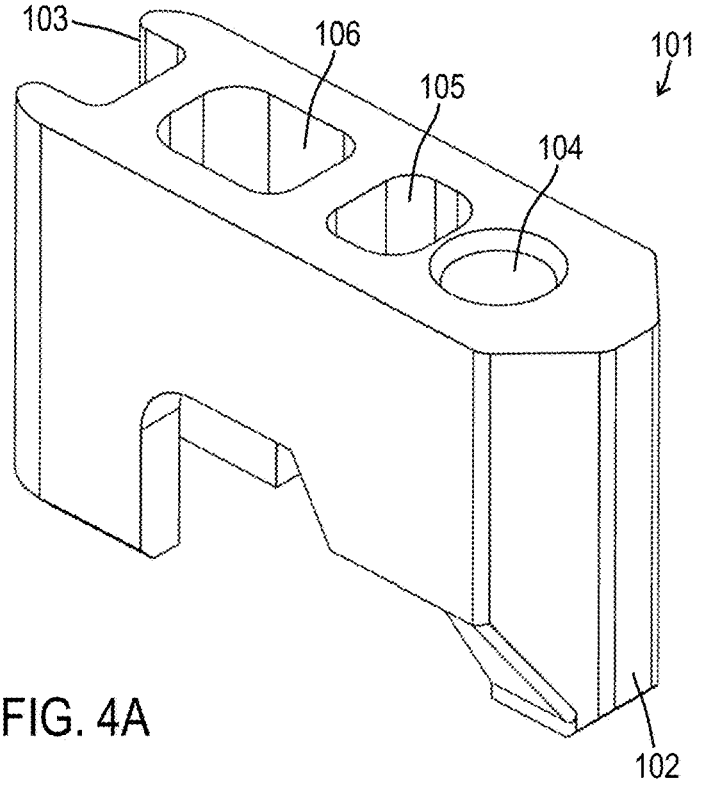
FIG. 4A is a front right perspective view of a body of the simulated trigger assembly of FIG. 1.
Figure 4B:
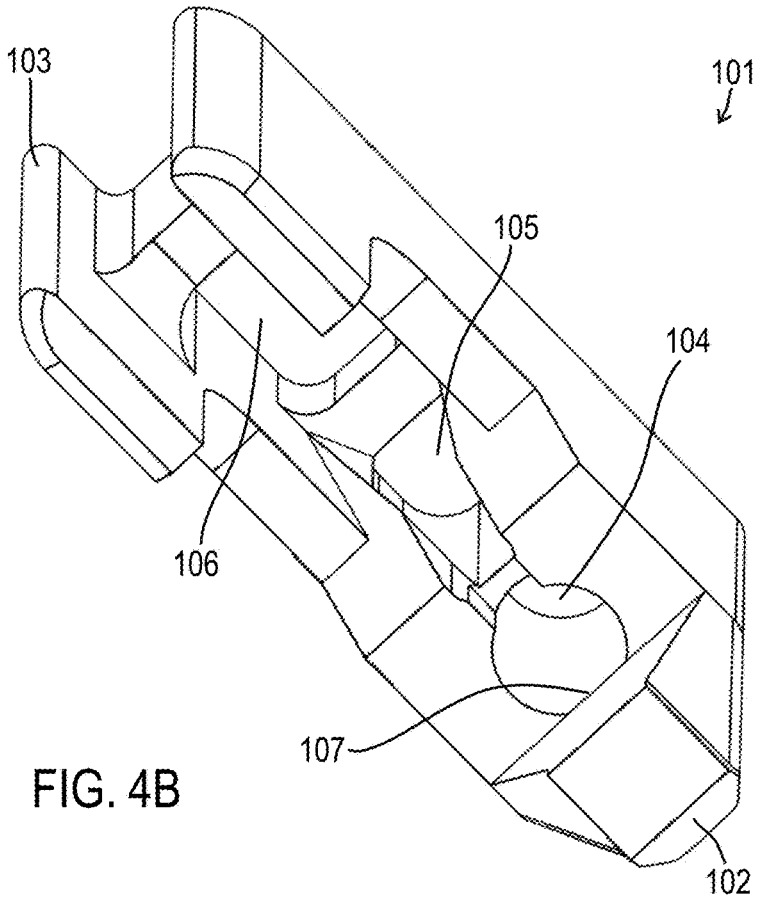
FIG. 4B is a bottom perspective view of the body of FIG. 4A.
Figure 4C:
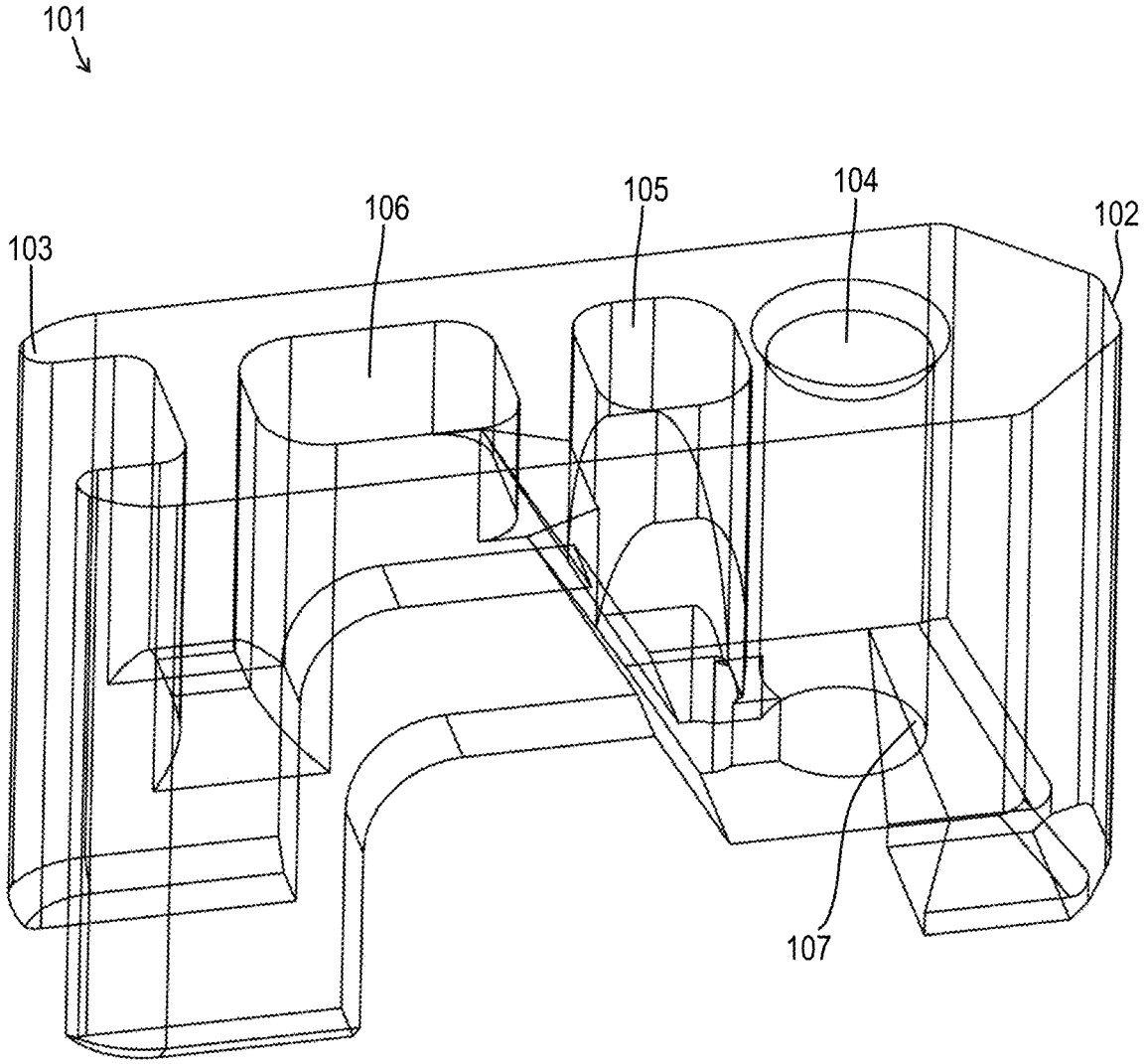
FIG. 4C is a right perspective view of the body of FIG. 4A.

In some embodiments, as shown in FIGS. 1 and 2, a simulated trigger assembly 100 is disposed within a lower receiver 50 and includes a body 101 and at least one attraction portion 201. The attraction portion 201 may be a magnet 201. The simulated trigger assembly 100 may be located at least partially within a trigger well 51 of the lower receiver 50. The body 101 may include a forward end 102, an aft end 103, and at least one recess (see FIGS. 3A-5B). In some cases, the body 101 includes a forward recess 104, a central recess 105, and a rear recess 106. One or more of the recesses 104-106 may be designed to match a cross-sectional shape of the attraction portion 201. For example, as shown in FIG. 3C, for a cylindrical or disk shape magnet 201 (circular cross-sectional shape), the forward recess 104 may be a round hole. The body 101, in some cases, may be a nonferrous or nonmagnetic material such as brass, plastic, aluminum, stainless steel, polymer, other nonferrous metallic materials, various polymer materials, and/or any other appropriate material.

The magnet 201 may be a permanent magnet, a neodymium magnet, a rare-earth magnet, a nano-structured magnet, a single-molecule magnet, a ceramic magnet, a ferrite magnet, an electromagnet, and/or any other appropriate material.

FIG. 3C shows the body 101 as transparent for clarity. The forward recess 104 may include a ledge 107 (see FIGS. 3C and 4B-5B) that defines the bottom location of the attraction portion 201 (see FIG. 3C). The attraction portion 201 may be attracted to the forward portion 61 of the trigger 60. Although the illustrated embodiments focus on arrangements where a magnet affects a forward section of the trigger 60, the magnetic effect may be arranged to affect a rear section of the trigger 60, an upper section of the trigger 60, a lower section of the trigger 60, and/or any other relevant component of the fire control group. For example, a first magnet may be arranged at the rear section of the trigger 60 and a second magnet may be disposed within body 101 where the poles are arranged such that the magnets repel one another. In such an arrangement, the simulated mechanical resistance for the trigger is created by pushing the two magnets together. A magnet may be located on the lower surface of the rear section of the trigger in some cases. In some embodiments, the upper location of the attraction portion 201 is dictated by a set screw 301 (see FIGS. 5A and 5B). The set screw 301, in some cases, may be a nonferrous or nonmagnetic material such as brass, plastic, aluminum, stainless steel, polymer, other nonferrous metallic materials, various polymer materials, and/or any other appropriate material.

Figure 9A:
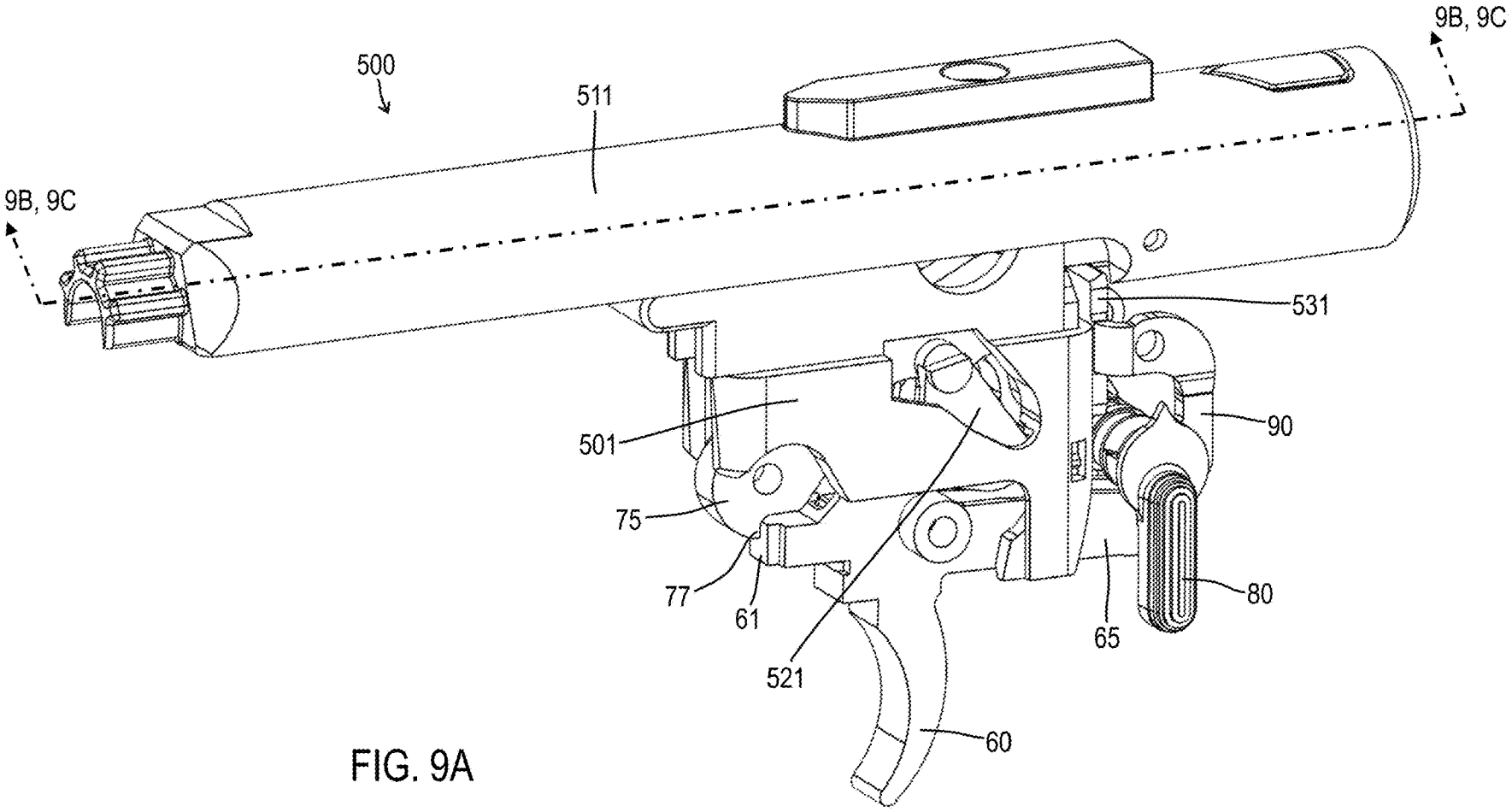
FIG. 9A is a front left perspective view of the simulated trigger assembly of FIG. 7.
Figure 9B:
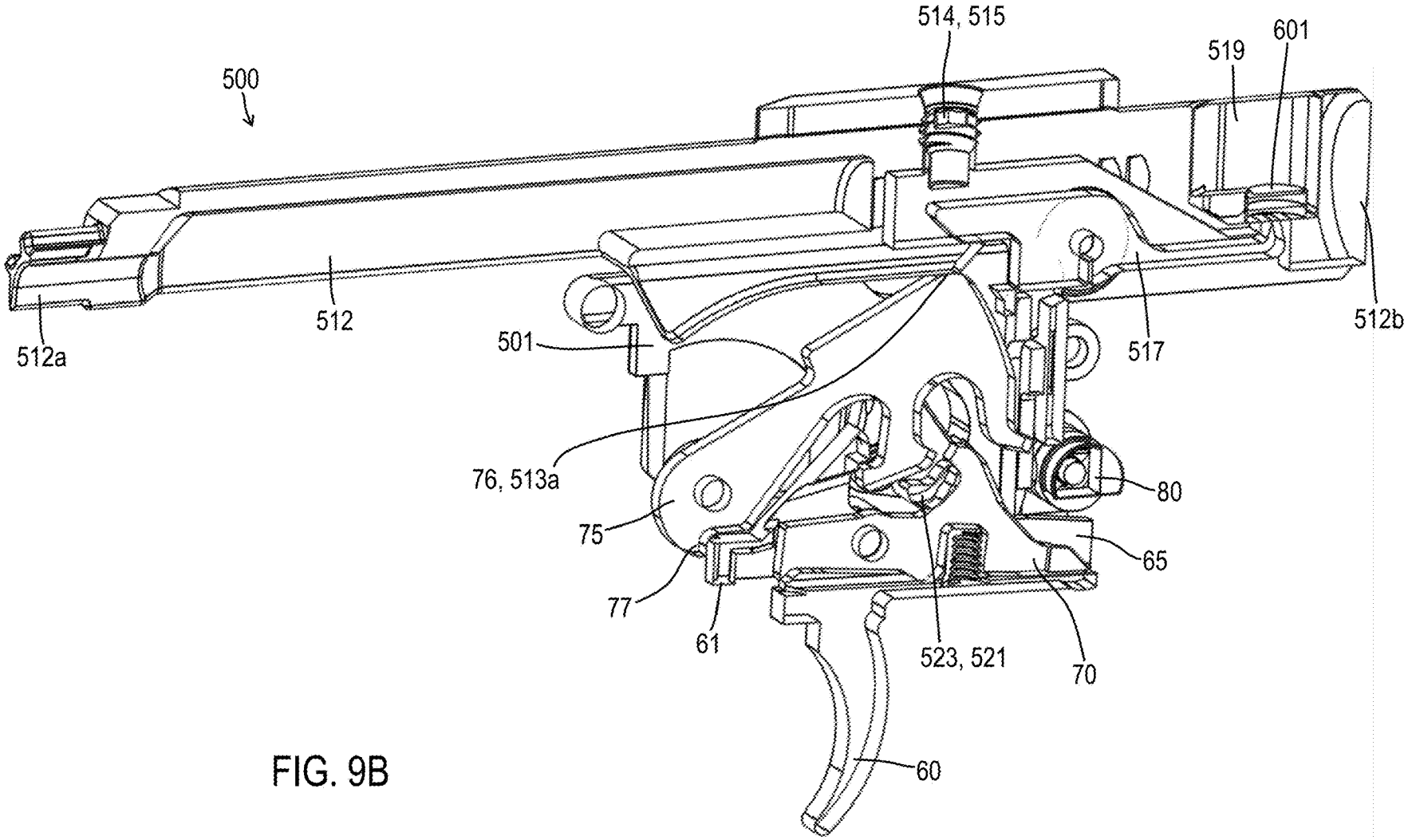
FIG. 9B is a cross-section view of the simulated trigger assembly of FIG. 9A.
Figure 9C:
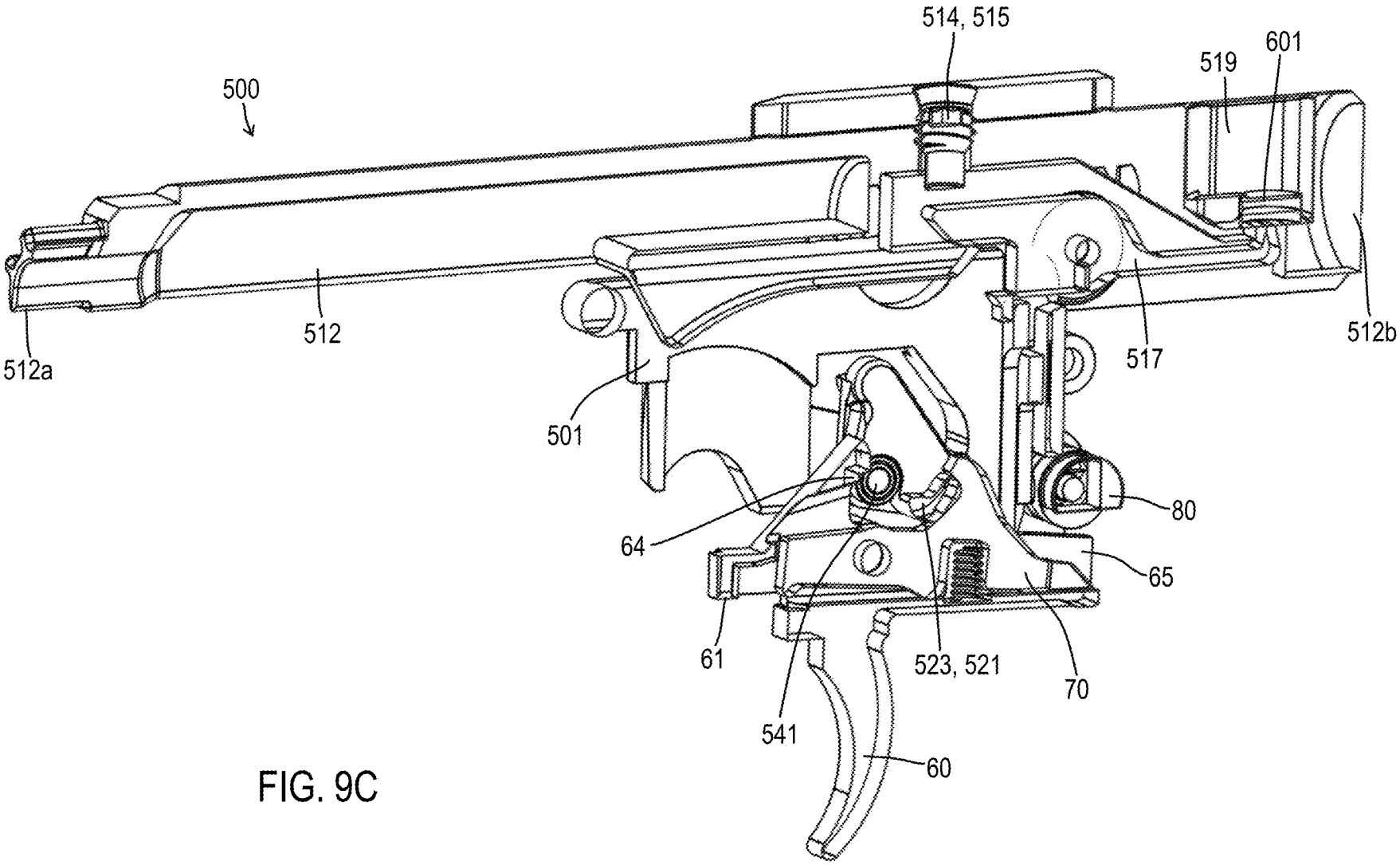
FIG. 9C is a cross-section view of the simulated trigger assembly of FIG. 9A without the hammer.

As shown in FIGS. 1 and 2, in some embodiments, the hammer and hammer pin are removed (e.g., see hammer 75 in FIGS. 9A and 9B). In some cases, the trigger 60, trigger pin 62, trigger spring 63, disconnector 70, and safety 80 may be left installed and unaltered. Removing the hammer creates a safe situation where there is no mechanism that can contact the firing pin. The simulated trigger assembly 100 functions with the standard bolt carrier group, charging handle, and upper receiver such that an operator can charge the firearm, insert magazines, and perform other firearm operations without the possibility of the hammer striking the firing pin.

After installing the simulated trigger assembly 100, the operator can pull trigger 60 (when the safety 80 is off as shown in FIGS. 1 and 2) such that the attraction between the forward portion 61 and the magnet 201 creates a repeatable resistance leading to the simulated "trigger break" when the forward portion 61 is pulled away from the magnet 201. The configuration where the trigger 60 has pivoted such that the forward portion 61 has separated from the magnet 201 is the simulated fired configuration. This effect allows the simulated trigger assembly 100 to simulate a typical trigger actuation. The trigger spring 63 causes the trigger 60 to reset back to the position shown in FIG. 3C (i.e., the initial configuration). In the initial configuration, the forward portion 61 may contact and/or be in close proximity to the magnet 201. In some embodiments, in the initial configuration, the forward portion 61 is at least immediately adjacent to the magnet 201. This means that the configuration of the forward portion 61, the ledge 107, and/or the magnet 201 may preclude the forward portion 61 from contacting the magnet 201 but these components are close enough to one another for the magnetic field to pull the components toward one another. The trigger 60 can be pulled repeatedly without having to reset the fire control group. This is different from typical similar firearms where the operator would have to reset the fire control group for each trigger actuation (e.g., by pulling the charging handle or racking a slide). Accordingly, the simulated trigger assembly 100 allows students and trainees to practice trigger actuation with appropriate ergonomic feedback. In some embodiments, the simulated trigger assembly 100 creates audible and tactile feedback to indicate to an operator and/or an instructor that the trigger 60 has been actuated.

Figure 5A:
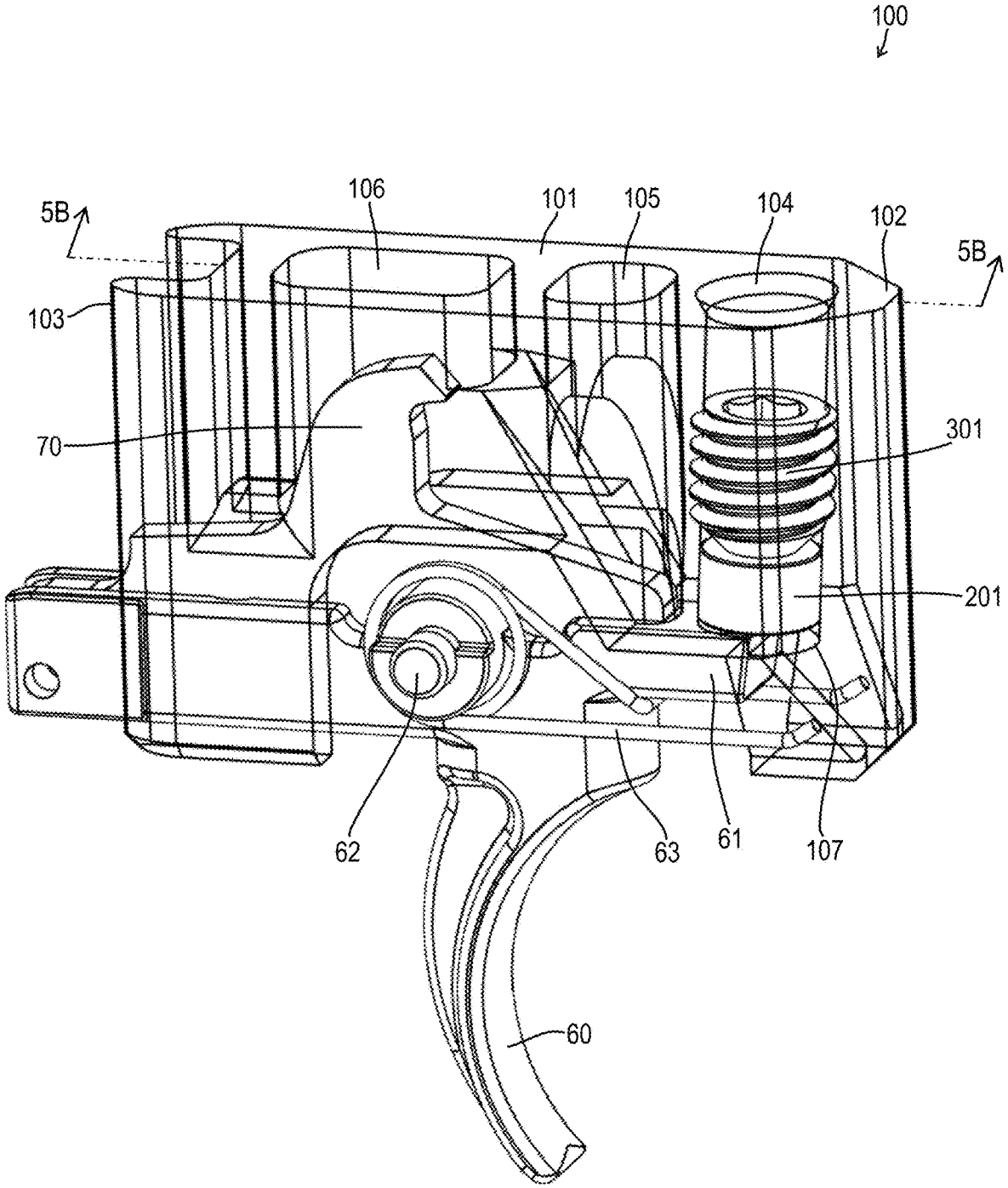
FIG. 5A is a right perspective view of a body of the simulated trigger assembly of FIG. 1.
Figure 5B:
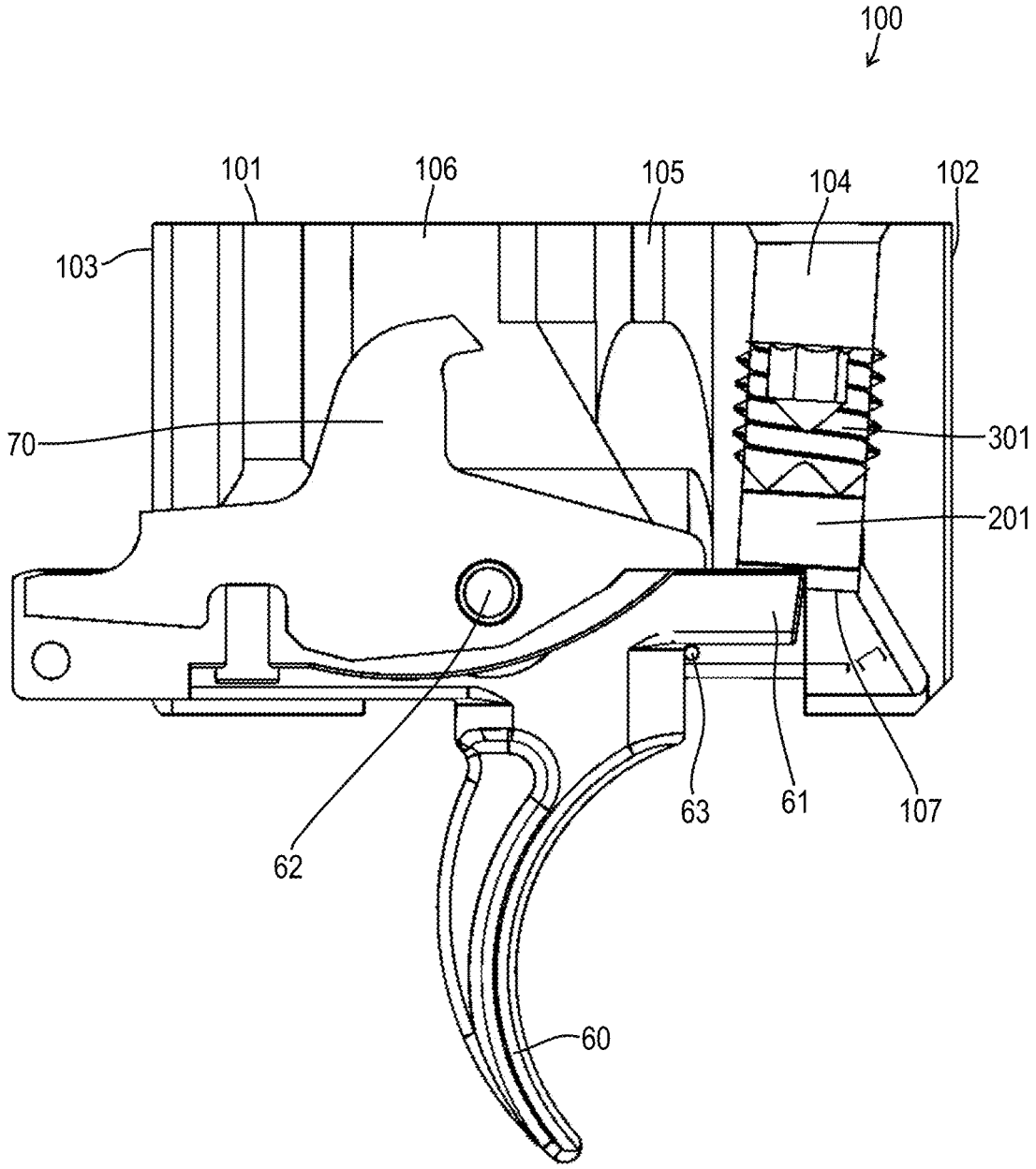
FIG. 5B is a cross-section view of the simulated trigger assembly of FIG. 5A.

As described above, an exemplary set screw 301 is illustrated in FIGS. 5A and 5B. Although not shown in FIG. 3C, a set screw 301 may be used to lock the magnet 201 in the position shown in FIG. 3C. To adjust the simulated trigger assembly 100, the magnet 201 may be removed and replaced with a different magnet (different strength, size, etc.) and/or a spacer may be inserted between the ledge 107 and the magnet 201 (removal of the set screw 301 may be necessary for these adjustments). These adjustments allow the simulated trigger assembly 100 to be tuned to provide different trigger pull weights such that an operator can simulate a particular firearm and/or fire control group.

In some embodiments, the simulated trigger assembly 100 is designed to constrain the magnet 201 between the set screw 301 and the ledge 107 (with or without optional spacer described above) to simulate a single stage fire control group. In other words, in the single stage configuration, the magnet 201 is arranged in a fixed position such that the magnet 201 does not move during operation of the simulated trigger assembly 100. One example of fixing or locking the magnet 201 is the set screw 301 pressing the magnet 201 against the ledge 107. As described above, a spacer may be inserted between the ledge 107 and the magnet 201.

In some embodiments, the simulated trigger assembly 100 is designed to simulate a two stage fire control group. FIGS. 5A and 5B illustrate examples of two stage simulations. FIG. 5A shows the body 101 as transparent for clarity. The simulated trigger assembly 100 may be designed such that the magnet 201 can move within forward recess 104 between the set screw 301 and the ledge 107. FIGS. 5A and 5B show an initial configuration before the trigger 60 has been actuated. In the initial configuration, the forward portion 61 may contact and/or be in close proximity to the magnet 201. In the first stage, the initial movement of the trigger 60 causes the forward portion 61 to pull the magnet 201 down until the magnet 201 reaches the ledge 107. The second stage occurs when the operator pulls the trigger 60 further causing the forward portion 61 to pull away from the magnet 201 (as described above in the context of the single stage fire control group). The travel (length) of the first stage can be adjusted by moving the set screw 301 closer/farther from the ledge 107. The second stage can be adjusted by replacing the magnet 201 (as described above in the context of the single stage fire control group).

The simulated trigger assembly 100 may be designed such that the trigger 60 includes a magnet and the attraction portion 201 includes a material that is attracted to the magnet of the trigger. For example, for the embodiment illustrated in FIG. 3B, the attraction portion 201 may be a steel component and the forward portion 61 may include a magnet. The forward portion 61 may be machined from a permanently magnetic material, may include a magnet attached or inserted therein, and/or any other relevant configuration.

In embodiments where the magnet 201 is an electromagnet, the simulated trigger assembly 100 may include wiring, at least one power source, and other relevant components. The simulated trigger assembly 100 may be designed with a switch and/or a circuit that allows current sent to the magnet 201 to be controlled such that mechanical resistance to pulling trigger 60 can be adjusted, increased, decreased, eliminated, and/or otherwise changed.

Figure 6:
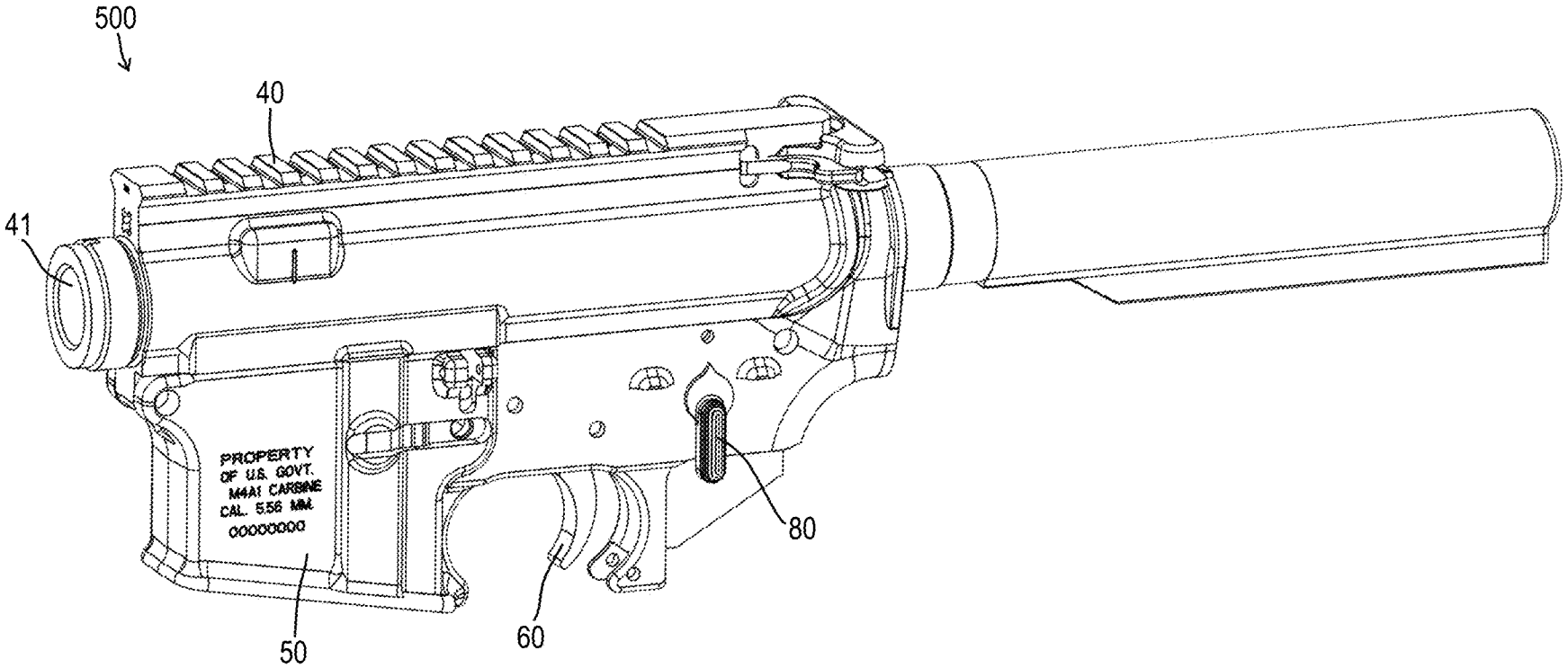
FIG. 6 is a front left perspective view of a simulated trigger assembly within a firearm according to certain embodiments of the present invention.
Figure 7:
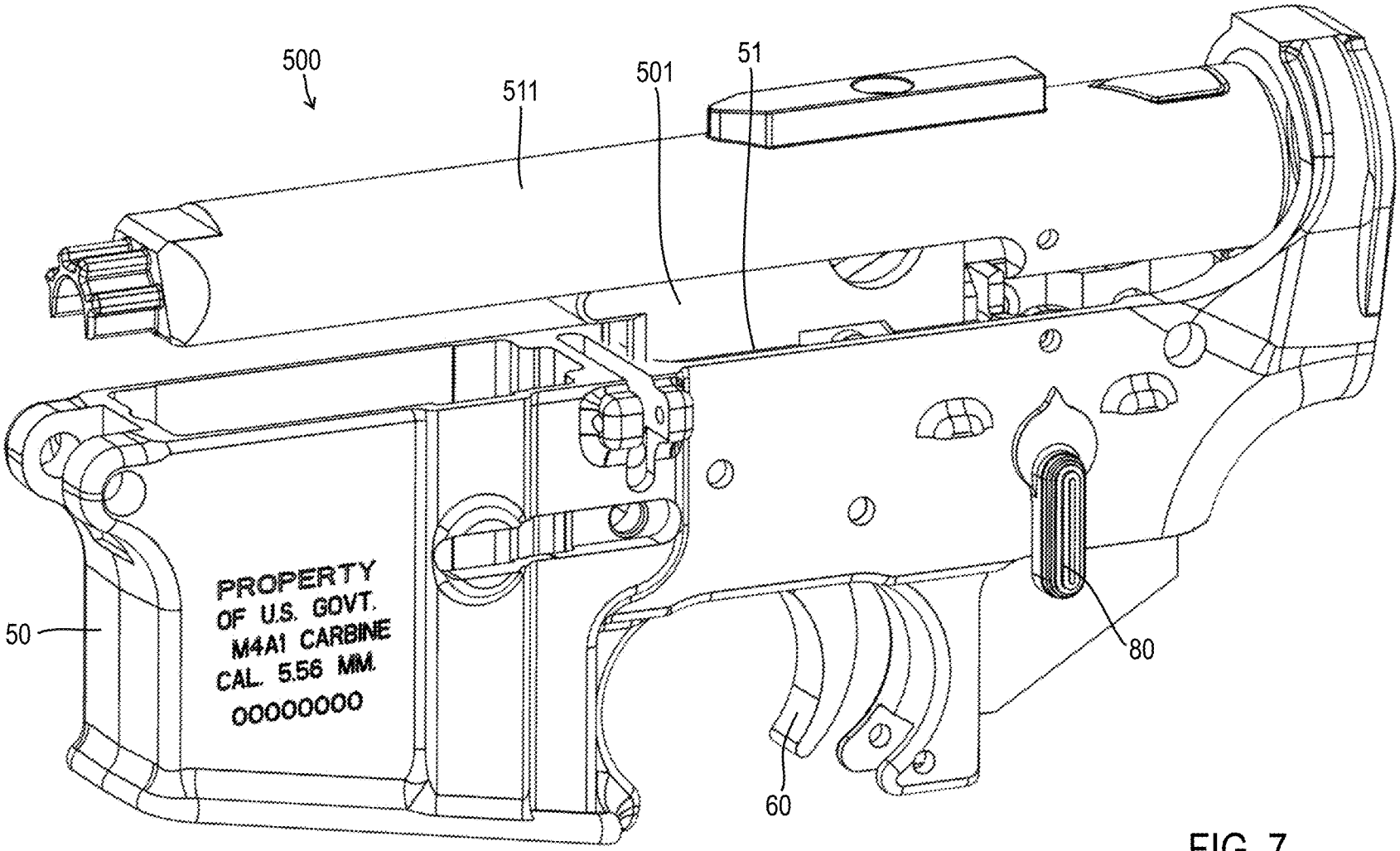
FIG. 7 is a front left perspective view of the simulated trigger assembly of FIG. 6 without the upper receiver and buffer tube.
Figure 8:
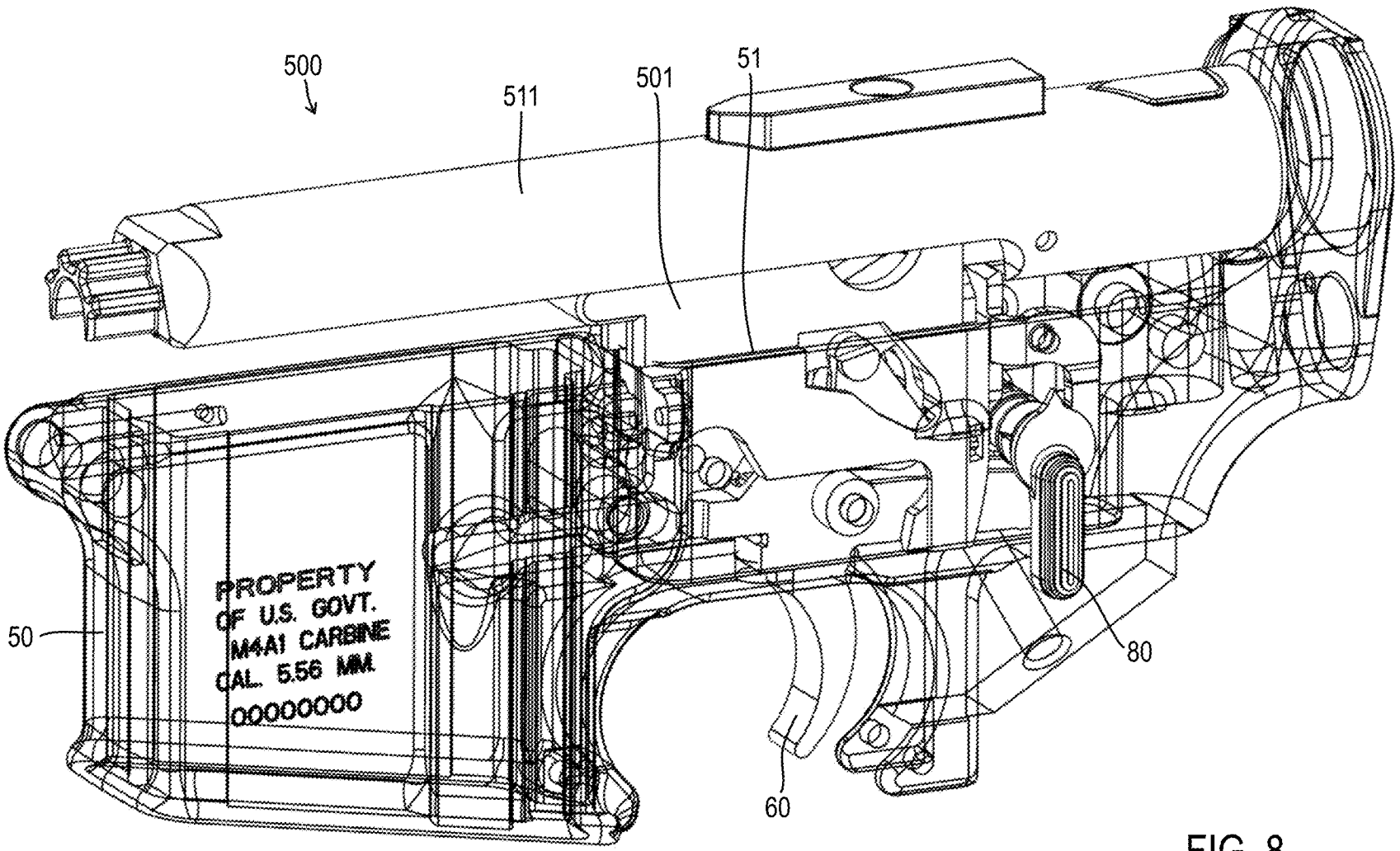
FIG. 8 is a front left perspective view of the simulated trigger assembly of FIG. 7 with the lower receiver shown transparent.

In some embodiments, as shown in FIGS. 6-8, a simulated trigger assembly 500 is disposed within a lower receiver 50 and includes a primary member 501, an upper member 511, a lever arm 517, an internal lever 521, a rear arm 531, and at least one attraction portion 601. The attraction portion 601 may be a magnet 601. The simulated trigger assembly 500 may be located at least partially within a trigger well 51 of the lower receiver 50 and/or at least partially within an interior 41 of the upper receiver 40. At least a portion of the primary member 501 and/or the upper member 511, in some cases, may be a nonferrous or nonmagnetic material such as brass, plastic, aluminum, stainless steel, polymer, other nonferrous metallic materials, various polymer materials, and/or any other appropriate material.

The magnet 601 may be a permanent magnet, a neodymium magnet, a rare-earth magnet, a nano-structured magnet, a single-molecule magnet, a ceramic magnet, a ferrite magnet, an electromagnet, and/or any other appropriate material.

Figure 10A:
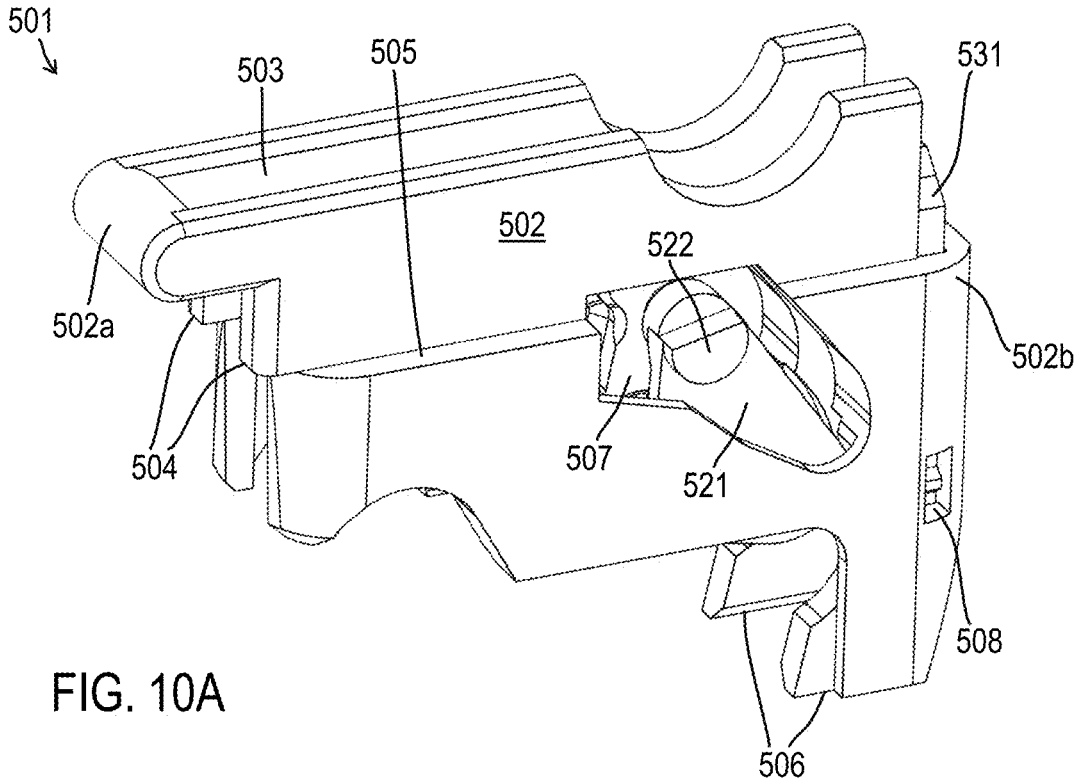
FIG. 10A is a front perspective view of a primary member of the simulated trigger assembly of FIG. 7.
Figure 10B:
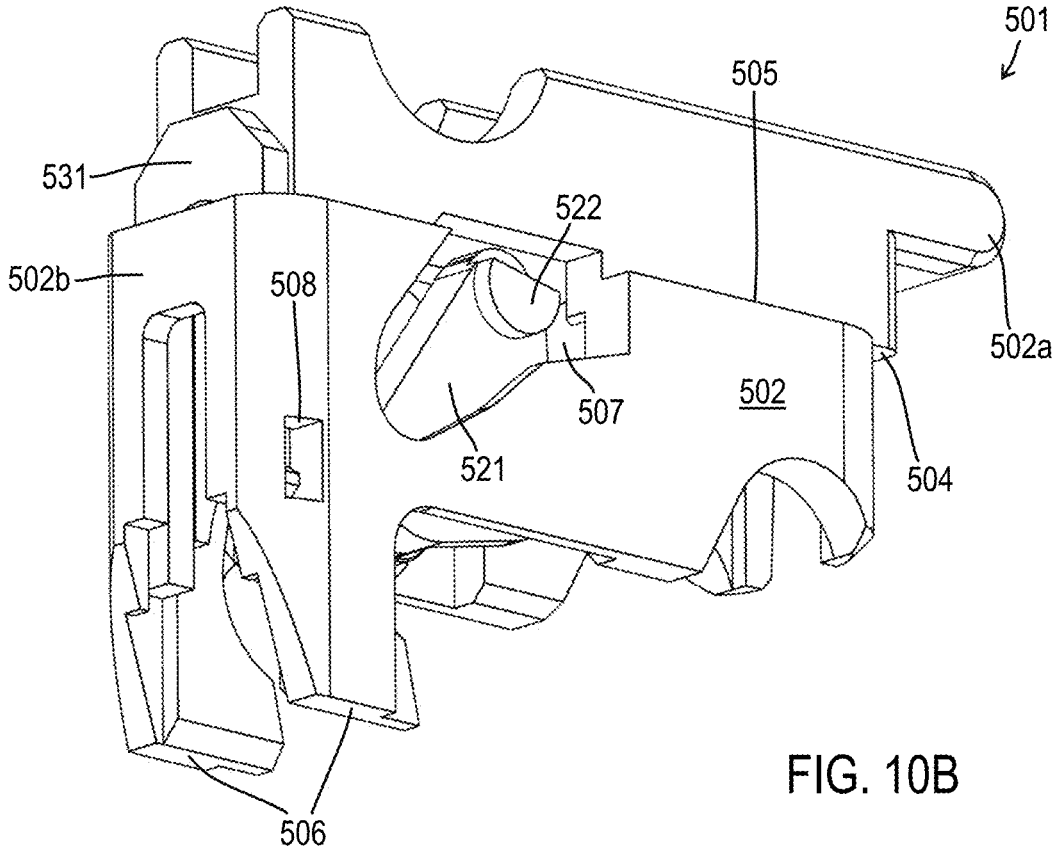
FIG. 10B is a rear perspective view of the primary member of FIG. 10A.
Figure 10C:
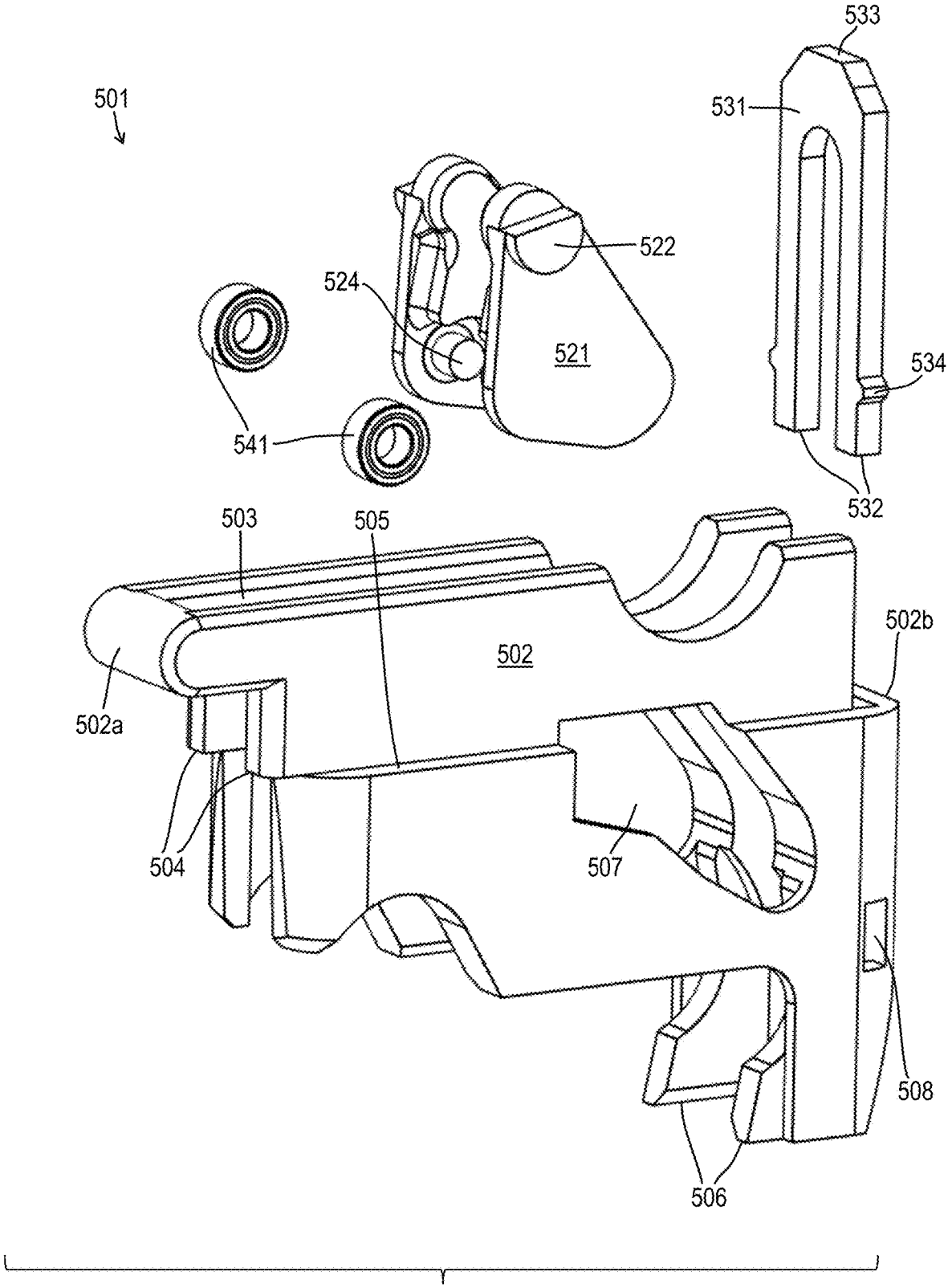
FIG. 10C is an exploded perspective view of the primary member of FIG. 10A.
Figure 14:
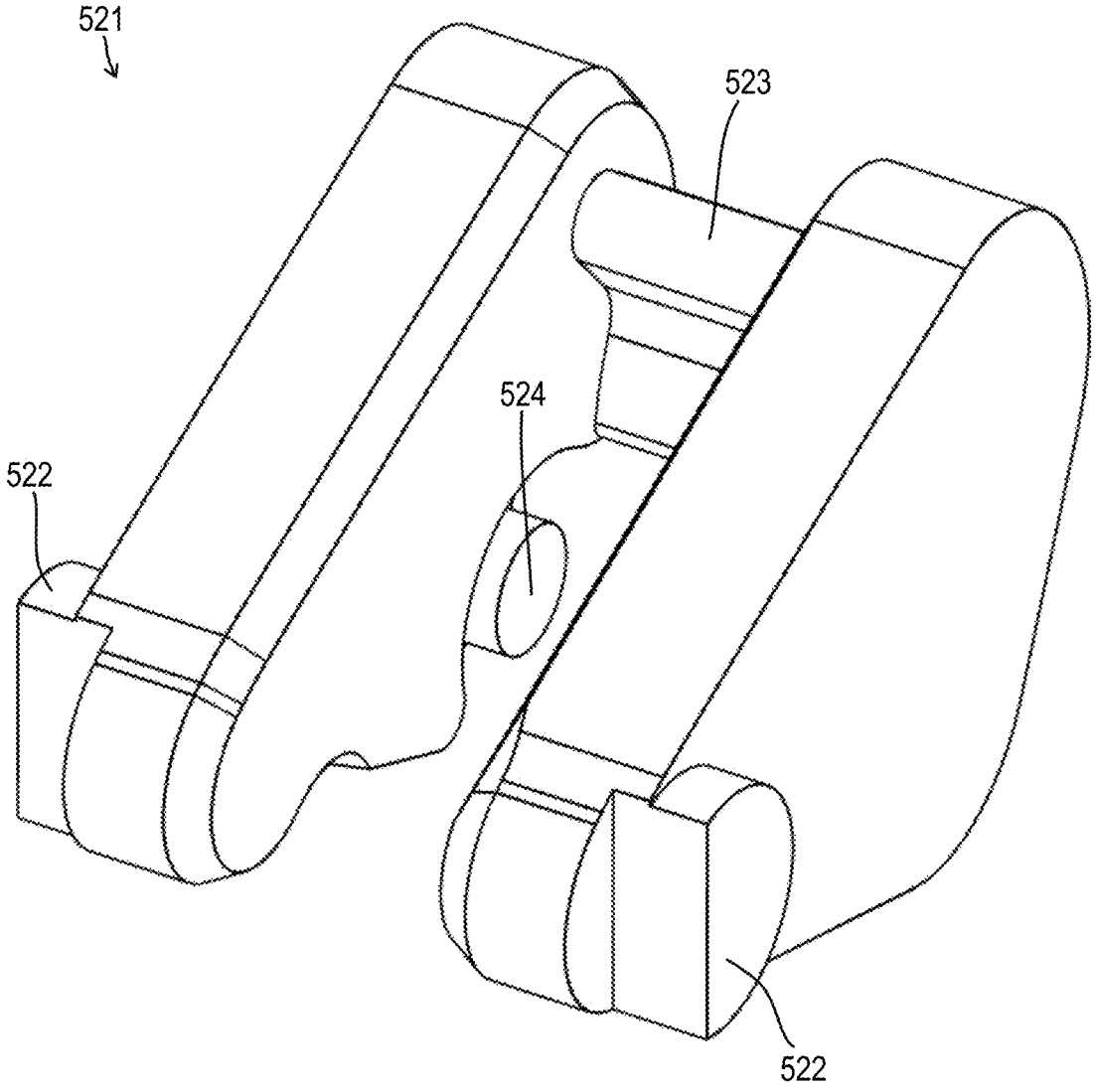
FIG. 14 is a perspective view of an internal lever of the simulated trigger assembly of FIG. 7.

As shown in FIGS. 10A-10C, the primary member 501 may include a primary body 502 with a forward end 502*a*, an aft end 502*b*, a central cavity 503, at least one forward ledge 504, at least one assembly surface 505, at least one lower ledge 506, at least one outboard opening 507, and at least one arm retaining feature 508. In some cases, the primary member 501 interfaces with the internal lever 521 and the rear arm 531. The internal lever 521 may be disposed in the central cavity 503 along with the trigger 60, the disconnector 70, and the hammer 75 (see FIG. 9B). To retain the internal lever 521 relative to the primary body 502, the internal lever 521 may include at least one protrusion 522 that is engaged within the at least one outboard opening 507. For example, as shown in FIGS. 10A, 10B, and 14, the internal lever 521 may include a protrusion 522 on each lateral side that each engage a corresponding outboard opening 507 on each lateral side of the primary body 502. The interior of the internal lever 521 may include a center portion 523 and at least one internal mount 524 designed to hold a bearing 541. In some embodiments, the internal lever 521 includes a pair of symmetric internal mounts 524 that each hold a bearing 541 (see FIG. 10C). The internal lever 521 may function to control movement of the trigger 60 and the disconnector 70. In some cases, the at least one bearing 541 interfaces with a trigger sear hook 64 of the trigger 60. In some embodiments, the trigger 60 is a two stage trigger. While the bearing(s) 541 contact the trigger 60, the center portion 523 may be pressed into the disconnector 70 (see FIGS. 9B and 9C). Based on the geometry of the internal lever 521, movement of the trigger 60 causes the internal lever 521 to push the disconnector 70 such that the disconnector 70 cannot engage the trigger 60 or the hammer 75. Pivoting motion of the trigger 60 does cause the rear portion 65 of the trigger 60 to interface with the rear arm 531. In some embodiments, the lower protrusion 513 of the upper member 511 contacts the distal portion 76 of the hammer 75. For example, as shown in FIG. 9B, the rear portion 513*a* of the lower protrusion 513 may push the distal portion 76 causing the hammer 75 to pivot beyond a typical condition causing the sear protrusion 77 to be offset from the forward portion 61 of the trigger 60. In other words, the lower protrusion 513 may cause the hammer 75 to rotate to configuration where the trigger 60 and the hammer 75 do not interface with one another. In some embodiments, the curved portion 513*b* of the lower protrusion 513 interfaces with the hammer 75 during installation (when the hammer 75 is up) such that pivoting the upper receiver 40 down to the lower receiver 50 will rotate the hammer 75 to the configuration shown in FIG. 9B.

The rear arm 531 may have an approximate 'U' shape with a lower portion 532, an upper portion 533, and at least one retaining portion 534 (see FIG. 10C). Pivoting motion of the trigger 60 cause the rear portion 65 to push up on the lower portion 532 causing the rear arm 531 to move up relative to the primary member 501. In some embodiments, upward motion of the rear arm 531 causes the upper portion 533 to contact the forward portion 517*b* of the lever arm 517. Each of the at least one retaining portion 534 may be designed to engage a corresponding arm retaining feature 508 of the primary member 501. In some cases, each retaining portion 534 is a protrusion and each arm retaining feature 508 is a slot such that the protrusion moves within the slot. These features may function to prevent the rear arm 531 from falling out of the corresponding cavity in the primary body 502.

The primary body 502 may include at least one mechanical feature to locate and/or constrain the primary member 501 relative to components of a firearm. For example, the at least one forward ledge 504 may engage an upper surface of the lower receiver 50. In some embodiments, the at least one lower ledge 506 sits on a lowermost interior surface of the trigger well of the lower receiver 50.

Figure 11A:
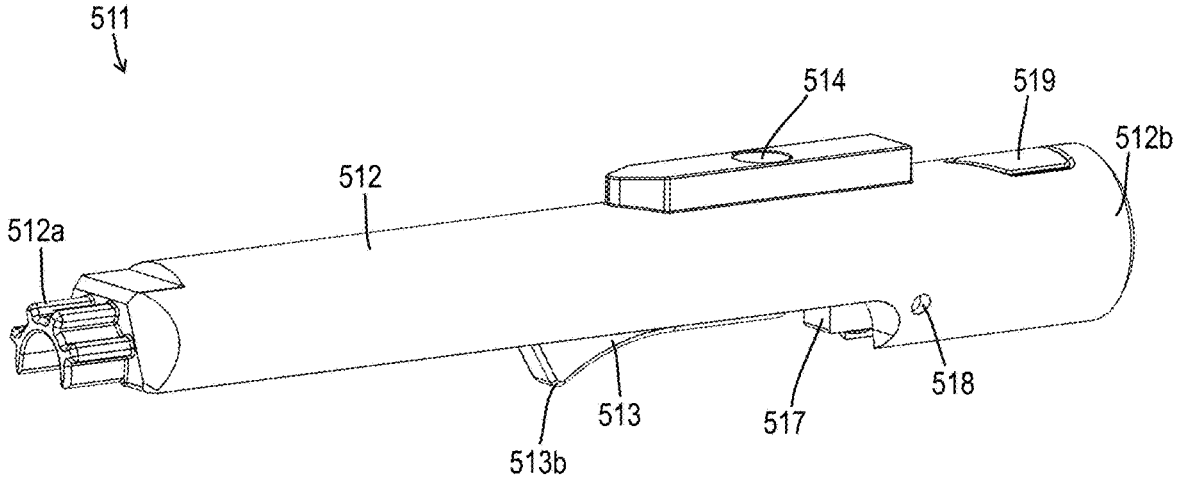
FIG. 11A is a front perspective view of an upper member of the simulated trigger assembly of FIG. 7.
Figure 11B:
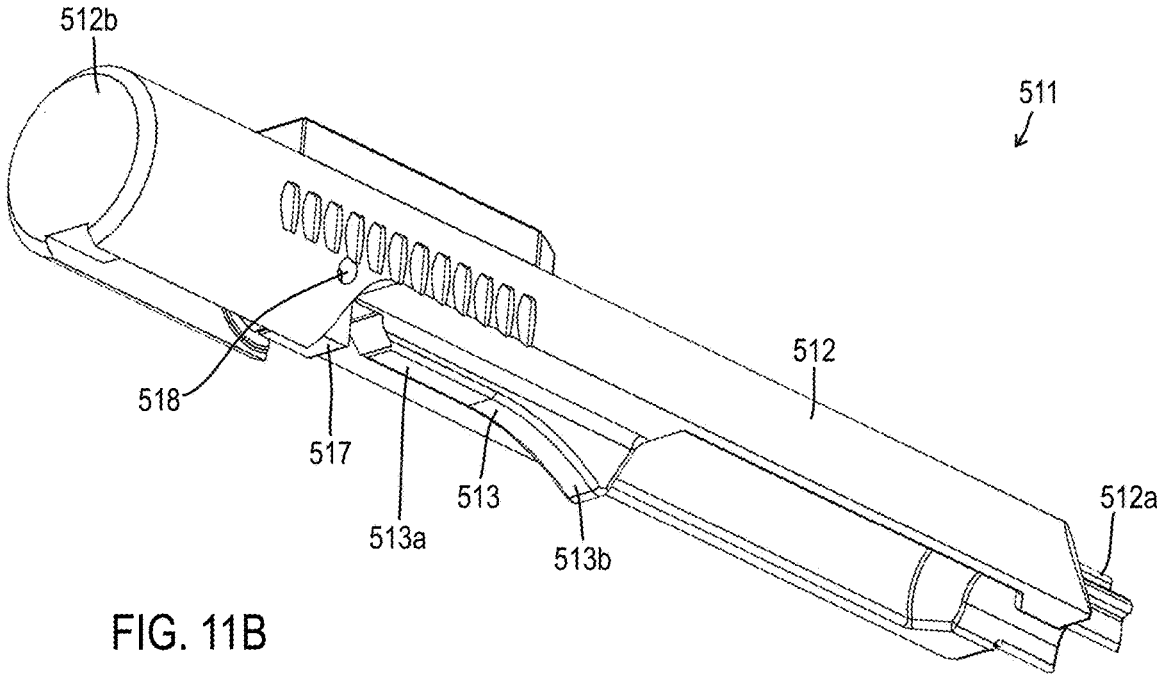
FIG. 11B is a rear perspective view of the upper member of FIG. 11A.
Figure 11C:
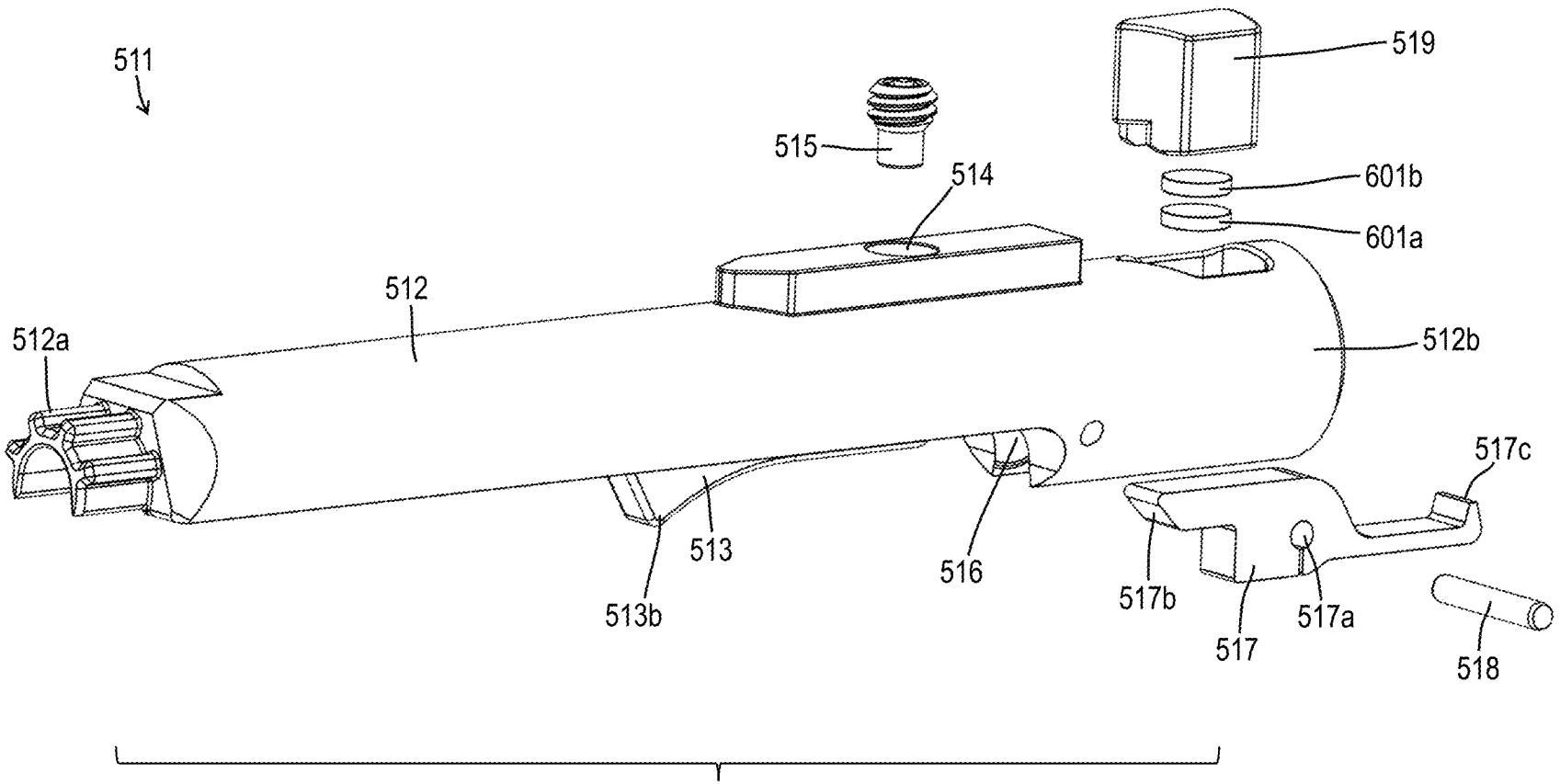
FIG. 11C is an exploded perspective view of the upper member of FIG. 11A.
Figure 11D:
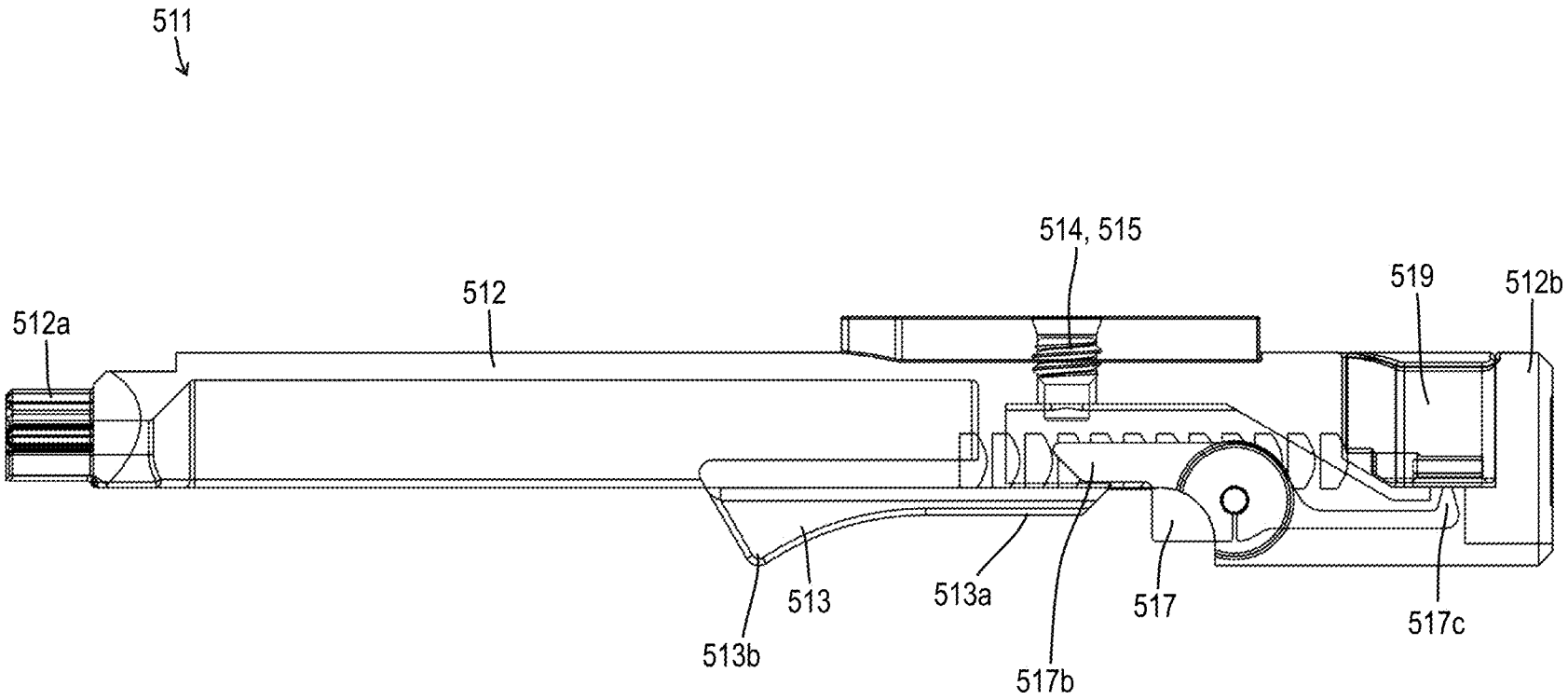
FIG. 11D is a side view of the upper member of FIG. 11A with the upper body shown transparent.
Figure 12:
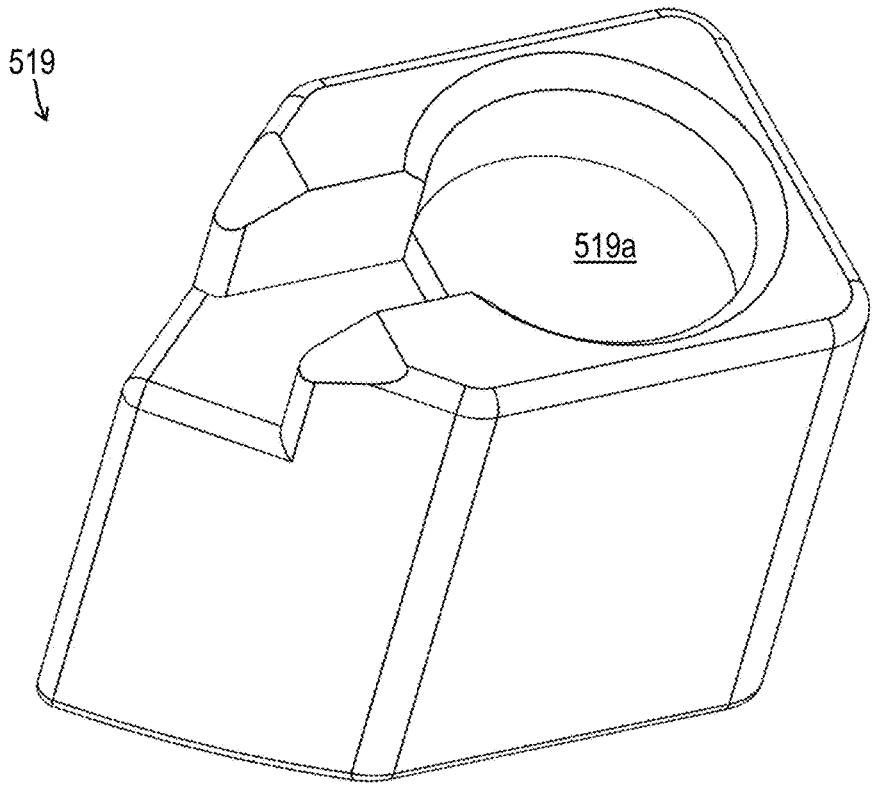
FIG. 12 is a perspective view of an insert member of the simulated trigger assembly of FIG. 7.
Figure 13:
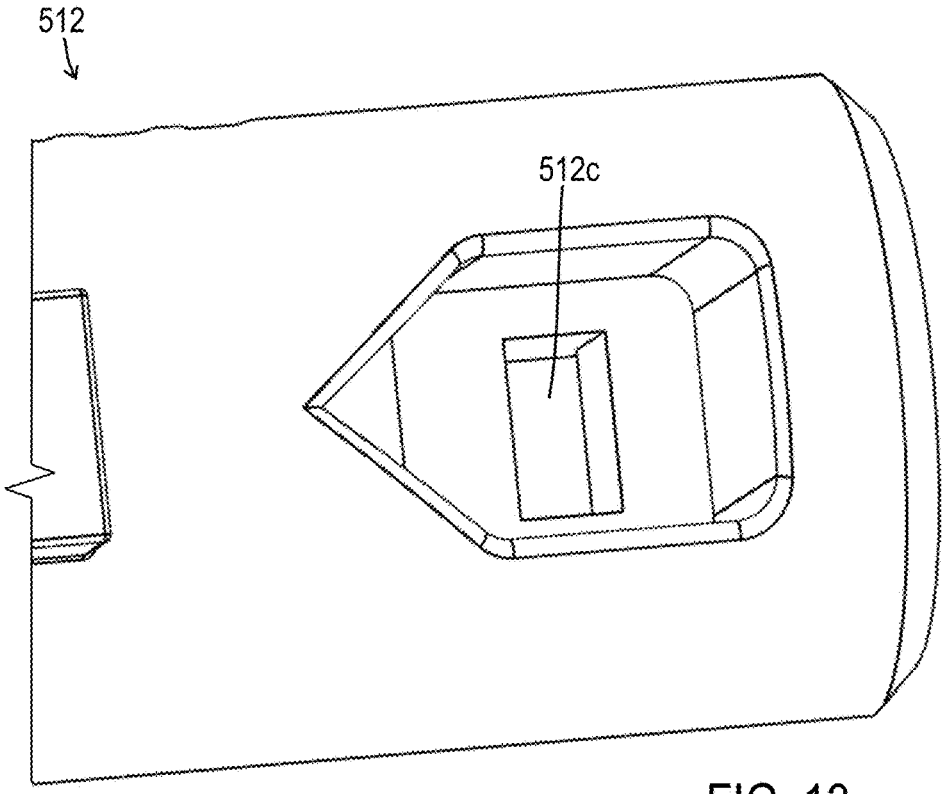
FIG. 13 is a partial perspective view of the upper body of the simulated trigger assembly of FIG. 7.

The upper member 511 may include an upper body 512 with a forward end 512*a*, an aft end 512*b*, a lower protrusion 513, a hole 514, and a central cavity 516 (see FIGS. 11A-11D). In some cases, the upper body 512 interfaces with the lever arm 517. The lever arm 517 may fit within the central cavity 516 and may pivot about pin 518 at hole 517*a* and include a forward portion 517*b* and a rear portion 517*c*. A fastener 515 may be inserted into hole 514 and act as a stop or limit for travel of the lever arm 517. In some embodiments, near the rear of the upper body 512, an insert member 519 secure at least one attraction portion 601. As shown in FIGS. 11C and 11D, there may multiple attraction portions 601 (e.g., 601*a*, 601*b*). One or both of the upper body 512 and the insert member 519 may include cavities designed to match a cross-sectional shape of the attraction portion(s) 601. For example, as shown in FIG. 12, the insert member 519 may be designed with a recess 519*a* to match a cylindrical or disk shape (circular cross-sectional) of the attraction portion(s) 601. In other embodiments, the recess 519*a* may have a square cross section, rectangular cross section, triangular cross section, other polygonal cross section, and/or any other appropriate shape. The upper body 512 may include a recess that corresponds to the insert member 519 and/or to the attraction portion(s) 201. In some embodiments, the upper body 512 includes a restricted opening 512*c* that prevents the attraction portion(s) 601 from passing through the bottom of the recess while still allowing the lever arm 517 to reach the attraction portion(s) 601. For example, as shown in FIG. 13, the restricted opening 512*c* may create a ledge using a slot that is large enough for the rear portion 517*c* of the lever arm 517 to at least partially pass through.

As shown in FIGS. 8-9B, in some embodiments, the trigger 60, disconnector 70, the hammer 75, safety 80, and auto sear 90 may be left installed and unaltered. In other words, the fire control group can remain unaltered. The simulated trigger assembly 500 may be designed to function by removing the bolt carrier group such that it can be replaced with the upper member 511. Removing the bolt carrier group creates a safe situation where there is no firing pin. The simulated trigger assembly 500 functions with the standard fire control group, charging handle, upper receiver 40, and lower receiver 50 such that an operator can charge the firearm, insert magazines, and perform other firearm operations without a functional the firing pin. In some embodiments, the simulated trigger assembly 500 is compatible with fire control groups that include or do not include the auto sear 90. In some cases, the presence of the auto sear 90 does not affect function of the simulated trigger assembly 500. Compatibility with the auto sear 90 allows for a wide range of military or law enforcement training applications.

After installing the simulated trigger assembly 500, the operator can pull trigger 60 (when the safety 80 is off as shown in FIGS. 6-9C) such that the attraction between the rear portion 517*c* of the lever arm 517 and the attraction portion(s) 601 creates a repeatable resistance leading to the simulated "trigger break" when the rear portion 517*c* is pulled away from the attraction portion(s) 601. The configuration where the lever arm 517 has pivoted such that the rear portion 517*c* has separated from the attraction portion(s) 601 is the simulated fired configuration. This effect allows the simulated trigger assembly 500 to simulate a typical trigger actuation. The trigger spring 63 causes the trigger 60 to reset back to the position shown in FIGS. 9A-9C (i.e., the initial configuration). In the initial configuration, the rear portion 517*c* may contact and/or be in close proximity to the attraction portion(s) 601. In some embodiments, in the initial configuration, the rear portion 517*c* is at least immediately adjacent to the attraction portion(s) 601. This means that the configuration of the rear portion 517*c*, the restricted opening 512*c*, and/or the attraction portion(s) 601 may preclude the rear portion 517*c* from contacting the attraction portion(s) 601 but these components are close enough to one another for the magnetic field to pull the components toward one another. The trigger 60 can be pulled repeatedly without having to reset the fire control group. This is different from typical similar firearms where the operator would have to reset the fire control group for each trigger actuation (e.g., by pulling the charging handle or racking a slide). Accordingly, the simulated trigger assembly 500 allows students and trainees to practice trigger actuation with appropriate ergonomic feedback. In some embodiments, the simulated trigger assembly 500 creates audible and tactile feedback to indicate to an operator and/or an instructor that the trigger 60 has been actuated.

Although not shown in the drawings, in some embodiments, the rear portion 517*c* of the lever arm 517 may also include a magnet. For example, the magnet attached or otherwise secured to the lever arm 517. In some cases, both the (i) attraction portion(s) 601 and the (ii) rear portion 517*c* include magnets that are arranged with the their poles oriented properly such that these components attract one another. In other embodiments, only one of the (i) attraction portion(s) 601 and the (ii) rear portion 517*c* include magnet(s).

In some embodiments, the attraction between the rear portion 517*c* of the lever arm 517 and the attraction portion(s) 601 creates a resistance but does not create any audible sound. The simulated trigger assembly 500 may be configured such that upward movement the forward portion 517*b* of the lever arm 517 (caused by the rear arm 531) causes audible feedback when the forward portion 517*b* contacts the fastener 515.

In embodiments where the magnet 601 is an electromagnet, the simulated trigger assembly 500 may include wiring, at least one power source, and other relevant components. The simulated trigger assembly 500 may be designed with a switch and/or a circuit that allows current sent to the magnet 601 to be controlled such that mechanical resistance to pulling trigger 60 can be adjusted, increased, decreased, eliminated, and/or otherwise changed.

The components of any of the components described herein may be formed of materials including, but not limited to, thermoplastic, carbon composite, plastic, nylon, polyethylene, polyetherimide, polypropylene, polyvinyl chloride, steel, aluminum, stainless steel, high strength aluminum alloy, tool steel, other plastic or polymer materials, other metallic materials, other composite materials, or other similar materials. Moreover, the components of the devices described herein may be attached to one another via suitable fasteners, which include, but are not limited to, screws, bolts, rivets, welds, over-molding, co-molding, injection molding, or other mechanical or chemical fasteners.

Different arrangements of the components depicted in the drawings or described above, as well as components and steps not shown or described, are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A simulated trigger assembly for a firearm comprising:
at least one body comprising at least one recess;
a magnet disposed within the at least one recess;
an initial configuration; and
a simulated fired configuration, wherein:
in the initial configuration the magnet is at least immediately adjacent to a moveable portion;
in the simulated fired configuration the moveable portion has moved to separate the moveable portion from the magnet;
the simulated trigger assembly is configured to simulate a two stage fire control group; and
the magnet is arranged in a fixed position.

2. The simulated trigger assembly of claim 1, wherein the moveable portion is a lever arm disposed above a fire control group.

3. The simulated trigger assembly of claim 1, wherein the moveable portion is a forward portion of a trigger.

4. The simulated trigger assembly of claim 1, wherein the at least one recess comprises a ledge that defines a bottom location of the magnet.

5. The simulated trigger assembly of claim 3, further comprising a set screw disposed within the at least one recess to define a movement limit for the moveable portion.

6. The simulated trigger assembly of claim 1, wherein the magnet comprises at least one shape selected from the group of a disk or a cylinder.

7. The simulated trigger assembly of claim 1, wherein a bolt carrier group is removed from the firearm to accommodate a portion of the simulated trigger assembly.

8. The simulated trigger assembly of claim 1, wherein the at least one body comprises a primary member and an upper member.

9. The simulated trigger assembly of claim 8, wherein:
the upper member comprises the moveable portion; and
the primary member comprises a rear arm that interfaces with both the moveable portion and a trigger.

10. A simulated trigger assembly for a firearm comprising:
a primary member disposed at least partially in a firearm lower receiver;
an upper member disposed at least partially in a firearm upper receiver;
a lever arm disposed at least partially in the upper member;
an internal lever disposed at least partially in the primary member;
a set screw disposed within the upper member to define a movement limit for the lever arm;
a rear arm disposed at least partially in the primary member; and
at least one attraction portion disposed at least partially in the upper member.

11. The simulated trigger assembly of claim 10, wherein the at least one attraction portion comprises a magnet.

12. The simulated trigger assembly of claim 10, wherein the lever arm is disposed above a fire control group.

13. The simulated trigger assembly of claim 10, wherein the upper member comprises at least one recess that comprises a ledge that defines a bottom location of the at least one attraction portion.

14. The simulated trigger assembly of claim 10, further comprising an initial configuration and a simulated fired configuration, wherein:
in the initial configuration the at least one attraction portion is at least immediately adjacent to the lever arm; and
in the simulated fired configuration the lever arm has moved to separate the lever arm from the at least one attraction portion.

15. The simulated trigger assembly of claim 10, wherein the simulated trigger assembly is configured to simulate a single stage fire control group.

16. The simulated trigger assembly of claim 10, wherein the at least one attraction portion comprises at least one shape selected from the group of a disk or a cylinder.

17. The simulated trigger assembly of claim 10, wherein:
the simulated trigger assembly is configured to simulate a two stage fire control group; and
the at least one attraction portion is arranged in a fixed position.

18. The simulated trigger assembly of claim 10, wherein a bolt carrier group is removed from the firearm to accommodate a portion of the simulated trigger assembly.

19. The simulated trigger assembly of claim 10, wherein the rear arm interfaces with both the lever arm and a trigger.

20. A simulated trigger assembly for a firearm comprising:
at least one body comprising at least one recess;
a magnet disposed within the at least one recess;
an initial configuration; and
a simulated fired configuration, wherein:
in the initial configuration the magnet is at least immediately adjacent to a moveable portion;
in the simulated fired configuration the moveable portion has moved to separate the moveable portion from the magnet; and
the moveable portion is a forward portion of a trigger.

* * * * *